US011650527B2

(12) United States Patent
Takagi

(10) Patent No.: US 11,650,527 B2
(45) **Date of Patent: *May 16, 2023**

(54) HEATER AND HEATING APPARATUS

(71) Applicants: KABUSHIKI KAISHA TOSHIBA, Tokyo (JP); TOSHIBA TEC KABUSHIKI KAISHA, Tokyo (JP)

(72) Inventor: Osamu Takagi, Chofu Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/591,544

(22) Filed: Feb. 2, 2022

(65) Prior Publication Data

US 2022/0155711 A1 May 19, 2022

Related U.S. Application Data

(63) Continuation of application No. 17/088,467, filed on Nov. 3, 2020, now Pat. No. 11,275,331, which is a (Continued)

(30) Foreign Application Priority Data

Jun. 20, 2016 (JP) ..... 2016-121446
Mar. 24, 2017 (JP) ..... 2017-059366

(51) Int. Cl.
*G03G 15/20* (2006.01)

(52) U.S. Cl.
CPC ..... *G03G 15/2042* (2013.01); *G03G 15/2007* (2013.01); *G03G 15/2053* (2013.01); *G03G 2215/2038* (2013.01)

(58) Field of Classification Search
CPC ..... G03G 15/2039; G03G 15/2042; G03G 15/2046; G03G 15/2053; G03G 15/2082; H05B 3/0066
See application file for complete search history.

(56) References Cited

U.S. PATENT DOCUMENTS 5,171,969 A 12/1992 Nishimura et al.
6,272,308 B1 8/2001 Maeda et al.
(Continued)

FOREIGN PATENT DOCUMENTS

JP S56-52889 U 5/1981
JP 2629980 B2 7/1997
(Continued)

OTHER PUBLICATIONS

Notice of Reasons for Refusal dated Feb. 9, 2021 in corresponding Japanese Patent Application No. 2017-059366, 15 pages (with Translation).
(Continued)

*Primary Examiner* — Carla J Therrien
(74) *Attorney, Agent, or Firm* — Kim & Stewart LLP

(57) ABSTRACT

A heater includes a heat-resistant insulating substrate, a plurality of heat generating members arrayed in a first direction on a first surface of the substrate, and a plurality of heat radiating bodies disposed on a surface different from the first surface of the substrate at positions corresponding to gap portions between the heat generating members to passively radiate heat generated thereby.

20 Claims, 14 Drawing Sheets

Related U.S. Application Data continuation of application No. 16/722,786, filed on Dec. 20, 2019, now Pat. No. 10,859,952, which is a continuation of application No. 16/396,423, filed on Apr. 26, 2019, now Pat. No. 10,551,776, which is a continuation of application No. 15/621,498, filed on Jun. 13, 2017, now abandoned.

(56) References Cited

U.S. PATENT DOCUMENTS

| | | | | |
|---|---|---|---|---|
| 8,498,547 | B2 | 7/2013 | Mitsuoka et al. | |
| 8,559,839 | B2 | 10/2013 | Hase et al. | |
| 9,261,832 | B2 | 2/2016 | Muramatsu et al. | |
| 10,551,776 | B2 * | 2/2020 | Takagi | G03G 15/2053 |
| 2004/0256372 | A1 | 12/2004 | Yoshioka et al. | |
| 2005/0220508 | A1 | 10/2005 | Masubuchi | |
| 2009/0230114 | A1 | 9/2009 | Taniguchi et al. | |
| 2011/0081157 | A1 | 4/2011 | Mitsuoka et al. | |
| 2011/0129268 | A1 | 6/2011 | Ishii et al. | |
| 2011/0194870 | A1 | 8/2011 | Hase et al. | |
| 2011/0206427 | A1 | 8/2011 | Iwaya et al. | |
| 2011/0222888 | A1 | 9/2011 | Ikebuchi et al. | |
| 2011/0229181 | A1 | 9/2011 | Iwaya et al. | |
| 2012/0213540 | A1 | 8/2012 | Igarashi | |
| 2012/0308280 | A1 | 12/2012 | Tsuruya et al. | |
| 2013/0071134 | A1 * | 3/2013 | Hikari | G03G 15/2042 399/88 |
| 2013/0108306 | A1 | 5/2013 | Saito et al. | |
| 2013/0336672 | A1 | 12/2013 | Mizuta et al. | |
| 2014/0138372 | A1 | 5/2014 | Ogura | |
| 2015/0037052 | A1 * | 2/2015 | Muramatsu | G03G 15/2042 399/334 |
| 2015/0139708 | A1 | 5/2015 | Shimura et al. | |
| 2016/0234882 | A1 * | 8/2016 | Takagi | H05B 3/22 |
| 2016/0238974 | A1 | 8/2016 | Kadowaki | |
| 2017/0363998 | A1 | 12/2017 | Takagi | |
| 2018/0004134 | A1 | 1/2018 | Nomura et al. | |
| 2018/0052411 | A1 | 2/2018 | Takagi | |

FOREIGN PATENT DOCUMENTS

| | | | |
|---|---|---|---|
| JP | 2009245729 | A | 10/2009 |
| JP | 2010-177142 | A | 8/2010 |
| JP | 2011081090 | A | 4/2011 |
| JP | 2011164264 | A | 8/2011 |
| JP | 2012189770 | A | 10/2012 |

OTHER PUBLICATIONS

Notice of Reasons for Refusal dated Jul. 6, 2021 in corresponding Japanese Patent Application No. 2017-059366, 11 pages (with Translation).

Notice of Reasons for Refusal dated Sep. 13, 2022, in corresponding Japanese Patent Application No. 2022-000110, 10 pages (with Translation).

* cited by examiner

HEATER AND HEATING APPARATUS

CROSS-REFERENCE TO RELATED APPLICATION

This application is a continuation of U.S. patent application Ser. No. 17/088,467, filed on Nov. 3, 2020, which application is a continuation of U.S. patent application Ser. No. 16/722,786, filed on Dec. 20, 2019, now U.S. Pat. No. 10,859,952, issued on Dec. 8, 2020, which application is a continuation of U.S. patent application Ser. No. 16/396,423, filed on Apr. 26, 2019, now U.S. Pat. No. 10,551,776, issued on Feb. 4, 2020, which application is a continuation of U.S. patent application Ser. No. 15/621,498, filed on Jun. 13, 2017, which application is based upon and claims the benefit of priority from the prior Japanese Patent Application No. 2016-121446, filed on Jun. 20, 2016, and Japanese Patent Application No. 2017-059366, filed on Mar. 24, 2017, the entire contents all of which are incorporated herein by reference.

FIELD

Embodiments described herein relate generally to a heater and a heating apparatus.

BACKGROUND

In a fixing apparatus mounted on an image forming apparatus in the related art, examined to separately dispose a plurality of heat generating bodies in a direction orthogonal to a conveying direction of a sheet and heat a toner image on the sheet. In this case, a gap is necessary between the heating bodies adjacent to each other. However, this gap portion cannot generate heat. Therefore, temperature drops in the gap portion and temperature unevenness occurs.

DETAILED DESCRIPTION

Figure 1:
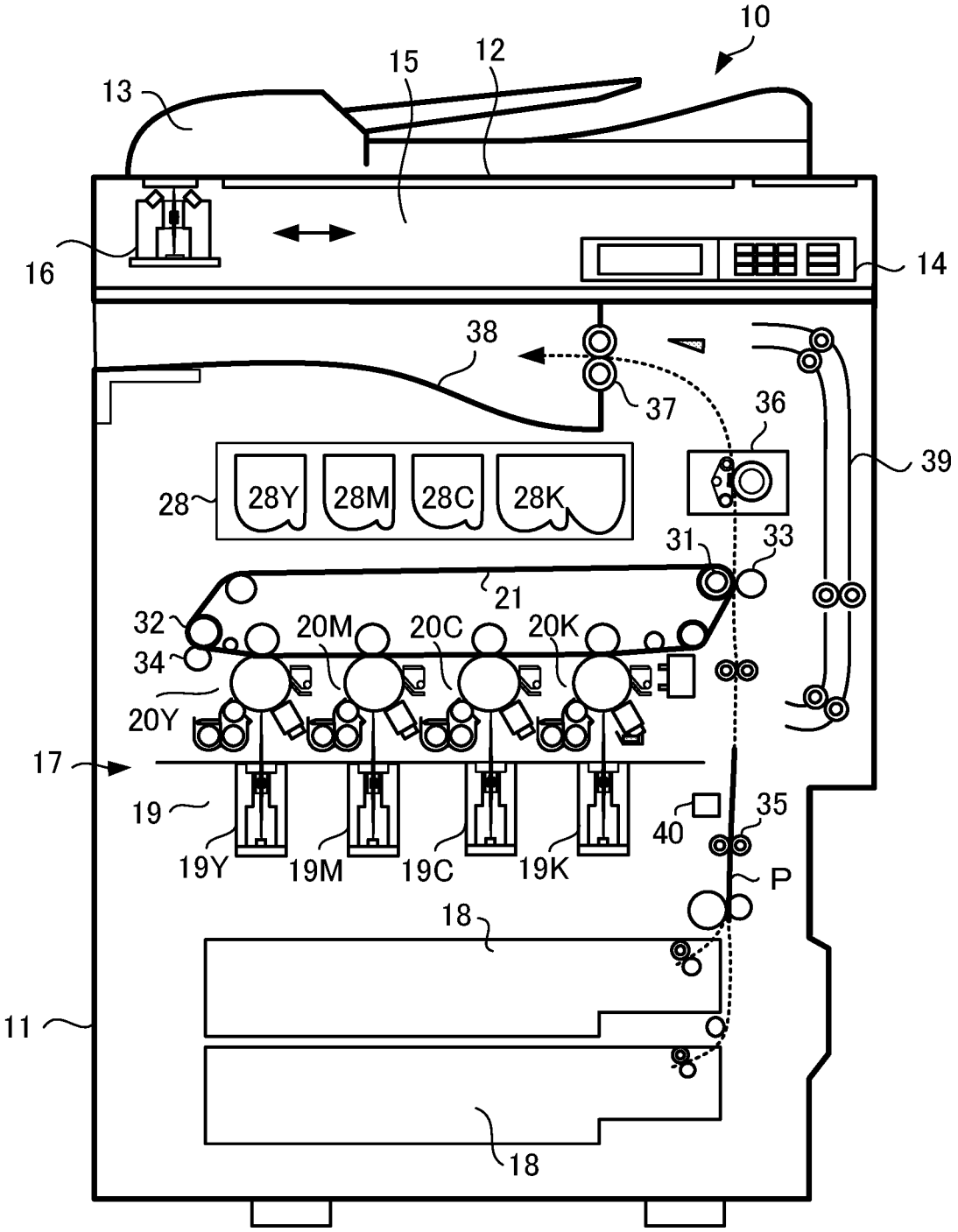
FIG. 1 is a configuration diagram showing an image forming apparatus including a fixing apparatus according to a first embodiment.

According to one embodiment, a heater includes a heat-resistant insulating substrate, a plurality of heat generating members arrayed in a first direction on a first surface of the substrate, and a plurality of heat radiating bodies disposed on a surface different from the first surface of the substrate at positions corresponding to gap portions between the heat generating members to passively radiate heat generated thereby.

Embodiments are explained below with reference to the drawings. Note that, in the figures, the same portions are denoted by the same reference numerals and signs.

First Embodiment

FIG. 1 is a configuration diagram showing an image forming apparatus including a heater and a fixing apparatus (a heating apparatus) according to a first embodiment. In FIG. 1, an image forming apparatus 10 is, for example, an MFP (Multi-Function Peripherals), which is a compound machine, a printer, or a copying machine. In the following explanation, the MFP is explained as an example.

A document table 12 of transparent glass is present in an upper part of a main body 11 of the MFP 10. An automatic document feeder (ADF) 13 is provided on the document table 12 to be capable of opening and closing. An operation unit 14 is provided in an upper part of the main body 11. The operation unit 14 includes an operation panel having various keys and a display device of a touch panel type.

A scanner unit 15, which is a reading device, is provided below the ADF 13 in the main body 11. The scanner unit 15 reads an original document fed by the ADF 13 or an original document placed on the document table 12 and generates image data. The scanner unit 15 includes a contact-type image sensor 16 (hereinafter simply referred to as image sensor). The image sensor 16 is disposed in a main scanning direction.

If the image sensor 16 reads an image of the original document placed on the document table 12, the image sensor 16 reads a document image line by line while moving along the document table 12. The image sensor 16 executes the line-by-line reading over the entire document size to read the original document for one page. If the image sensor 16 reads an image of the original document fed by the ADF 13, the image sensor 16 is present in a fixed position (a position shown in the figure). Note that the main scanning direction is a direction orthogonal to a moving direction of the image sensor 16 moving along the document table 12.

Further, the MFP 10 includes a printer unit 17 in the center in the main body 11. The printer unit 17 processes image data read by the scanner unit 15 or image data created by a personal computer or the like to form an image on a recording medium (e.g., a sheet). The MFP 10 includes, in a lower part of the main body 11, a plurality of paper feeding cassettes 18 that store sheets of various sizes. Note that, as the recording medium on which an image is formed, there are an OHP sheet and the like besides the sheet. However, in an example explained below, an image is formed on the sheet.

The printer unit 17 includes photoconductive drums and includes, as exposing devices a scanning head 19 including LEDs. The printer unit 17 scans the photoconductive drums with rays from the scanning head 19 and generates images. The printer unit 17 is, for example, a color laser printer by a tandem type. The printer unit 17 includes image forming units 20Y, 20M, 20C, and 20K of respective colors of yellow (Y), magenta (M), cyan (C), and black (K).

The image forming units 20Y, 20M, 20C, and 20K are disposed in parallel from an upstream side to a downstream side on a lower side of an intermediate transfer belt 21. The scanning head 19 includes a plurality of scanning heads 19Y, 19M, 19C, and 19K corresponding to the image forming units 20Y, 20M, 20C, and 20K.

Figure 2:
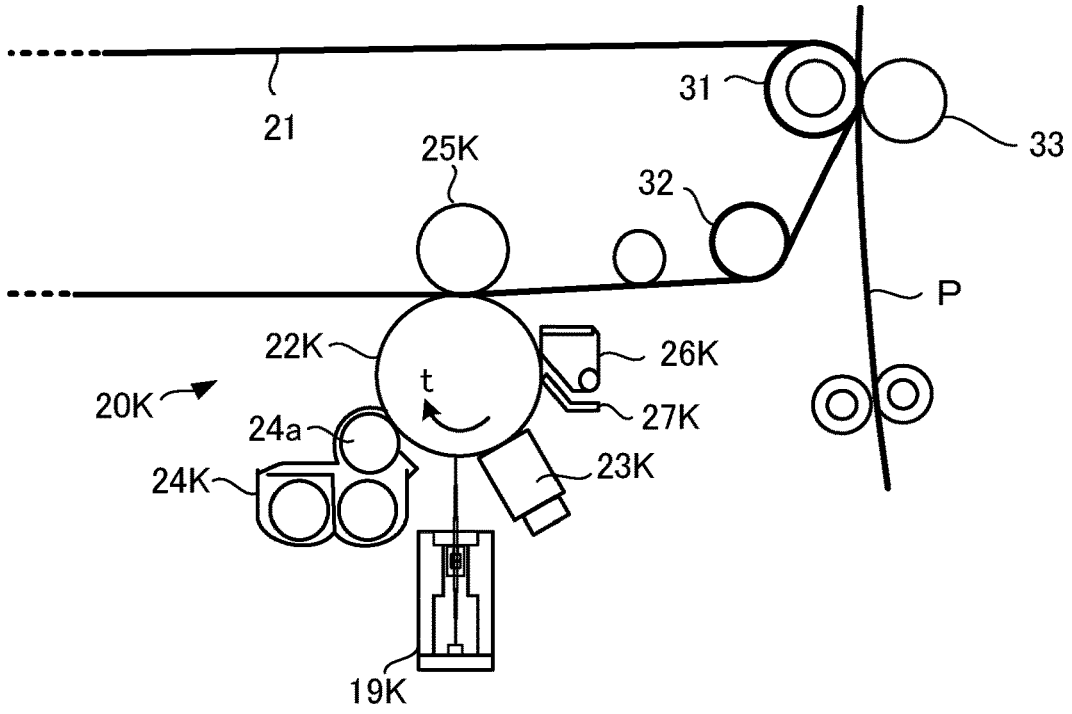
FIG. 2 is an enlarged configuration diagram of a part of an image forming unit in the first embodiment.

FIG. 2 is an enlarged configuration diagram of the image forming unit 20K among the image forming units 20Y, 20M, 20C, and 20K. Note that, in the following explanation, the image forming units 20Y, 20M, 20C, and 20K have the same configuration. Therefore, the image forming unit 20K is explained as an example.

The image forming unit 20K includes a photoconductive drum 22K, which is an image bearing body. An electrifying charger (a charging device) 23K, a developing device 24K, a primary transfer roller (a transfer device) 25K, a cleaner 26K, a blade 27K, and the like are disposed along a rotating direction t around the photoconductive drum 22K. Light is irradiated on an exposure position of the photoconductive drum 22K from the scanning head 19K to form an electrostatic latent image on the photoconductive drum 22K.

The electrifying charger 23K of the image forming unit 20K uniformly charges the surface of the photoconductive drum 22K. The developing device 24K supplies, with a developing roller 24*a* to which a developing bias is applied, a black toner to the photoconductive drum 22K and performs development of the electrostatic latent image. The cleaner 26K removes a residual toner on the surface of the photoconductive drum 22K using the blade 27K.

As shown in FIG. 1, a toner cartridge 28 that supplies toners to developing devices 24Y to 24K is provided above the image forming units 20Y to 20K. The toner cartridge 28 includes toner cartridges 28Y, 28M, 28C, and 28K of the colors of yellow (Y), magenta (M), cyan (C), and black (K).

The intermediate transfer belt 21 is stretched and suspended by a driving roller 31 and a driven roller 32 and moves in a cyclical manner. The intermediate transfer belt 21 is opposed to and in contact with photoconductive drums 22Y to 22K. A primary transfer voltage is applied to a position of the intermediate transfer belt 21 opposed to the photoconductive drum 22K by the primary transfer roller 25K. A toner image on the photoconductive drum 22K is primarily transferred onto the intermediate transfer belt 21 by the application of the primary transfer voltage.

A secondary transfer roller 33 is disposed to be opposed to the driving roller 31 that stretches and suspends the intermediate transfer belt 21. If a sheet P passes between the driving roller 31 and the secondary transfer roller 33, a secondary transfer voltage is applied to the sheet P by the secondary transfer roller 33. The toner image on the intermediate transfer belt 21 is secondarily transferred onto the sheet P. A belt cleaner 34 is provided near the driven roller 32 in the intermediate transfer belt 21.

As shown in FIG. 1, paper feeding rollers 35 are provided between the paper feeding cassettes 18 and the secondary transfer roller 33. The paper feeding rollers 35 convey the sheet P extracted from the paper feeding cassettes 18. Further, a fixing apparatus 36, which is a heating apparatus, is provide downstream of the secondary transfer roller 33. A conveying roller 37 is provided downstream of the fixing apparatus 36. The conveying roller 37 discharges the sheet P to a paper discharge section 38. Further, a reversal conveying path 39 is provided downstream of the fixing apparatus 36. The reversal conveying path 39 reverses the sheet P and guides the sheet P in the direction of the secondary transfer roller 33. The reversal conveying path 39 is used if duplex printing is performed.

FIGS. 1 and 2 show an example of the embodiment. However, the structures of image forming apparatus portions other than the fixing apparatus 36 are not limited to the example shown in FIGS. 1 and 2. The structure of a publicly-known electrophotographic image forming apparatus can be used.

Figure 3:
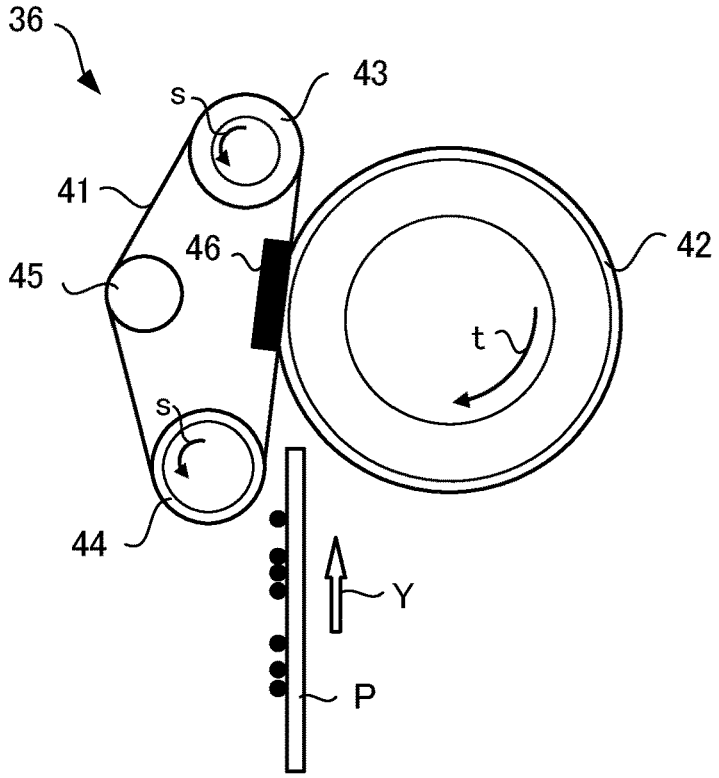
FIG. 3 is a configuration diagram showing an example of the fixing apparatus according to the first embodiment.

FIG. 3 is a configuration diagram showing the fixing apparatus 36, which is the heating apparatus. The fixing apparatus 36 includes a fixing belt (an endless belt) 41, which is a rotating body, a press roller 42 (a pressurizing roller), belt conveying rollers 43 and 44, and a tension roller 45. The fixing belt 41 is an endless belt on which an elastic layer is formed. The fixing belt 41 is rotatably stretched and suspended by the belt conveying rollers 43 and 44 and the tension roller 45. The tension roller 45 applies predetermined tension to the fixing belt 41.

A tabular heating member 46 (a heater) is provided between the belt conveying rollers 43 and 44 on the inner side of the fixing belt 41. The heating member 46 is in contact with the inner side of the fixing belt 41. The heating member 46 is disposed to be opposed to the press roller 42 via the fixing belt 41. The heating member 46 is pressed in the direction of the press roller 42 and forms a fixing nip having a predetermined width between the fixing belt 41 and the press roller 42.

If the sheet P passes the fixing nip, a toner image on the sheet P is fixed on the sheet P with heat and pressure. A driving force is transmitted to the press roller 42 by a motor and the press roller 42 rotates (a rotating direction is indicated by an arrow t in FIG. 3). The fixing belt 41, the belt conveying rollers 43 and 44, and the tension roller 45 rotate following the rotation of the press roller 42 (a rotating direction of the fixing belt 41, the belt conveying rollers 43 and 44, and the tension roller 45 is indicated by an arrow s shown in FIG. 3).

In the fixing belt 41, which is the rotating body, a silicon rubber layer (an elastic layer) having thickness of 200 μm (micrometers) is formed, for example, on the outer side on a SUS or nickel substrate having thickness of 50 μm or polyimide, which is heat-resistant resin having thickness of 70 μm. The outermost circumference of the fixing belt 41 is covered by a surface protecting layer of PFA or the like. In the press roller 42, which is the pressurizing body, for example, a silicon sponge layer having thickness of 5 mm is formed on the surface of an iron bar of ϕ10 mm. The outermost circumference of the press roller 42 is covered by a surface protecting layer of PFA or the like. A detailed configuration of the heating member 46 is explained below.

Figure 4:
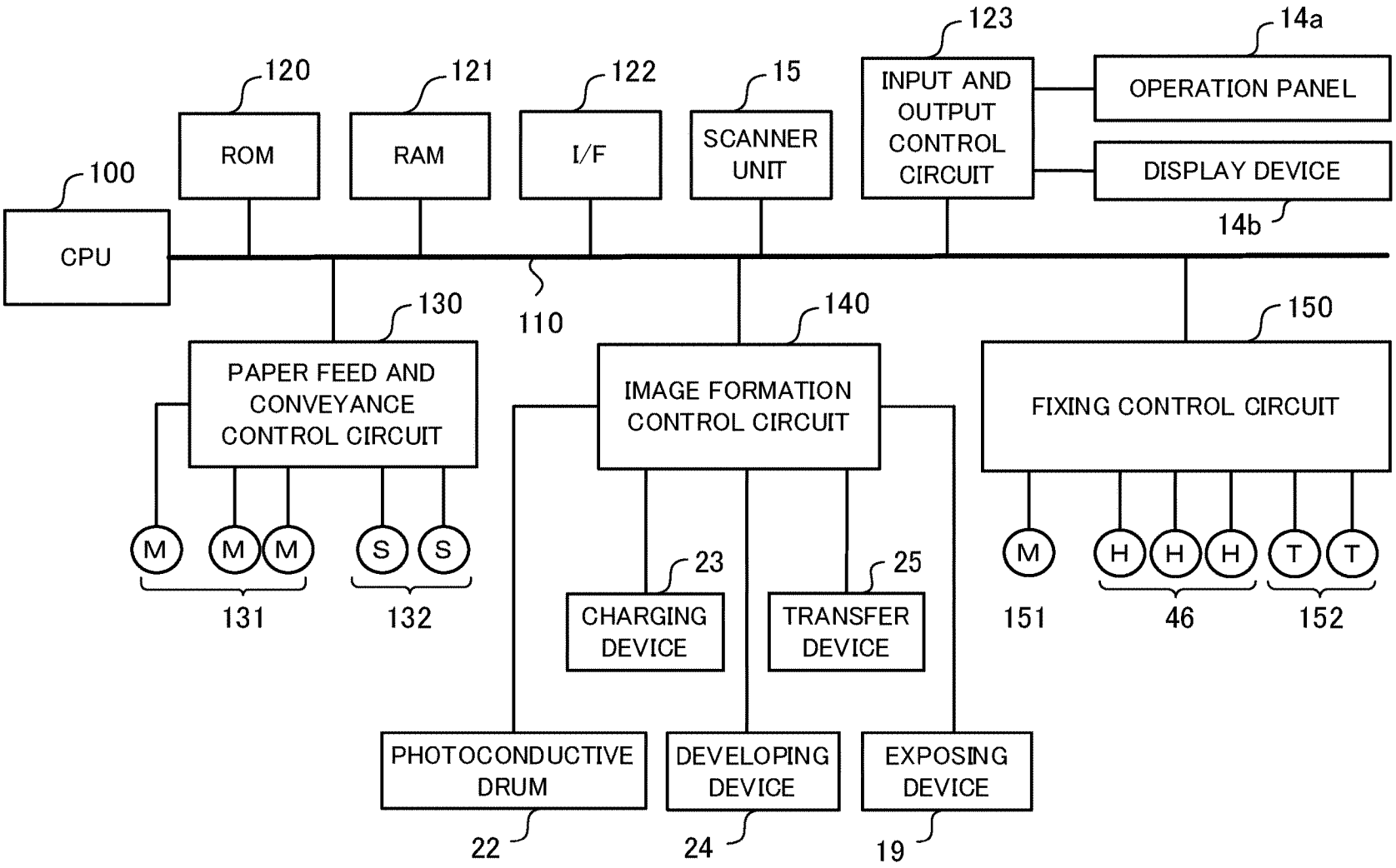
FIG. 4 is a block diagram showing a control system of an MFP in the first embodiment.

FIG. 4 is a block diagram showing a configuration example of a control system of the MFP 10 in the first embodiment. The control system includes, for example, a CPU 100 that controls the entire MFP 10, a bus line 110, a read only memory (ROM) 120, and a random access memory (RAM) 121. The control system includes an interface (I/F) 122, the scanner unit 15, an input and output control circuit 123, a paper feed and conveyance control circuit 130, an image formation control circuit 140, and a fixing control circuit 150. The CPU 100 and the circuits are connected via the bus line 110.

The CPU 100 controls the entire MFP 10. The CPU 100 realizes a processing function for image formation by executing a computer program stored in the ROM 120 or the RAM 121. The ROM 120 stores a control program, control data, and the like for controlling a basic operation of image formation processing. The RAM 121 is a working memory.

The ROM 120 (or the RAM 121) stores, for example, control programs for the image forming unit 20, the fixing apparatus 36, and the like and various control data used by the control programs. Specific examples of the control data in this embodiment include a correspondence relation between the size (the width in the main scanning direction) of a printing region in a sheet and a heat generating member to be energized.

A fixing temperature control program of the fixing apparatus 36 includes a determination logic for determining the size of an image forming region in a sheet on which a toner image is formed. The fixing temperature control program includes a heating control logic for selecting a switching element of a heat generating member corresponding to a position where the image forming region passes and energizing the switching element before the sheet is conveyed into the inside of the fixing apparatus 36 and controlling heating in the heating member 46.

The I/F 122 performs communication with various apparatuses such as a user terminal and a facsimile. The input and output control circuit 123 controls an operation panel 14*a* and a display device 14*b*. An operator can designate, for example, a sheet size and the number of copies of an original document by operating the operation panel 14*a*.

The paper feed and conveyance control circuit 130 controls a motor group 131 and the like that drive the paper feeding rollers 35, the conveying roller 37 in a conveying path, or the like. The paper feed and conveyance control circuit 130 controls the motor group 131 and the like on the basis of control signals from the CPU 100. The paper feed and conveyance control circuit 130 controls the motor group 131 and the like taking into account detection results of various sensors 132 near the paper feeding cassettes 18 or on the conveying path.

The image formation control circuit 140 controls the photoconductive drum 22, the charging device 23, the exposing device (the scanning head) 19, the developing device 24, and the transfer device 25 respectively on the basis of control signals from the CPU 100.

The fixing control circuit 150 controls, on the basis of a control signal from the CPU 100, a driving motor 151 that rotates the press roller 42 of the fixing apparatus 36. The fixing control circuit 150 controls energization to a heat generating member (explained below) of the heating member 46. The fixing control circuit 150 receives input of temperature information of the heating member 46 from a temperature detecting member 152 such as a thermistor and controls the temperature of the heating member 46.

Note that, in this embodiment, the control program and the control data of the fixing apparatus 36 are stored in a storage device of the MFP 10 and executed by the CPU 100. However, an arithmetic operation device and a storage device may be separately provided exclusively for the fixing apparatus 36.

Figure 5:
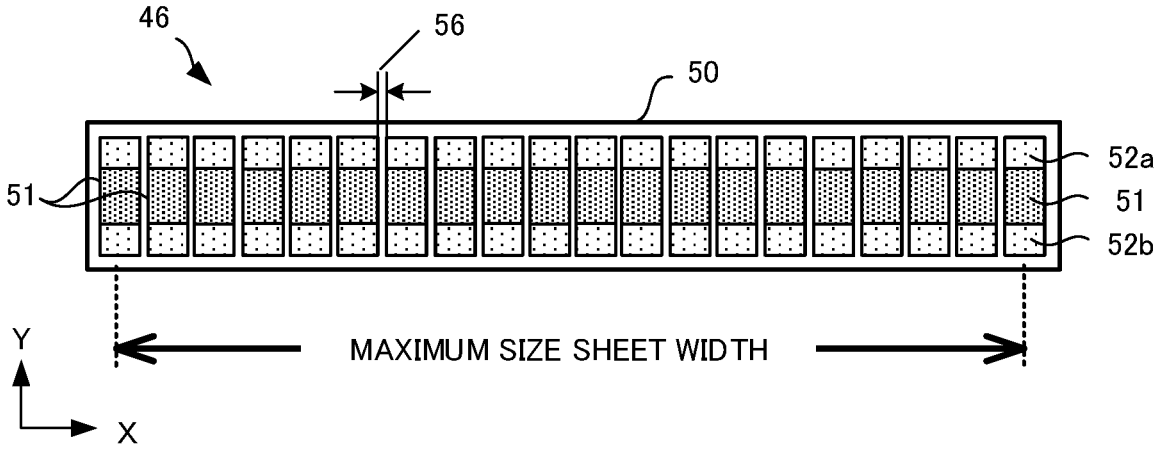
FIG. 5 is a plan view showing a basic configuration of a heating member in the first embodiment.

FIG. 5 is a plan view showing a basic configuration of the heating member 46 (the heater) in the first embodiment. The heating member 46 is configured by a heating member group. As shown in FIG. 5, in the heating member 46, a plurality of heat generating members 51 having a predetermined width are arrayed in a longitudinal direction (the left-right direction in the figure) on a heat-resistant insulating substrate, for example, a ceramic substrate 50.

The heat generating members 51 are formed, for example, directly or by stacking a glaze layer and a heat generation resistance layer on one surface of the ceramic substrate 50. As explained above, the heat generation resistance layer configures the heat generating members 51. The heat generation resistance layer is formed of a known material such as $TaSiO_2$. The heat generating members 51 are divided into a predetermined length and a predetermined number of pieces in the longitudinal direction of the heating member 46. Details of the disposition of the heat generating members 51 are explained below. Electrodes 52*a* and 52*b* are formed at both end portions in a latitudinal direction of the heating member 46, that is, a sheet conveying direction of the heat generating members 51 (the vertical direction in the figure).

Note that the sheet conveying direction (the latitudinal direction of the heating member 46) is explained as a Y direction in the following explanation. The longitudinal direction of the heating member 46 is a direction orthogonal to the sheet conveying direction. The longitudinal direction of the heating member 46 corresponds to the main scanning direction in forming an image on a sheet, that is, a sheet width direction. The longitudinal direction of the heating member 46 is explained as an X direction in the following explanation.

Figure 6:
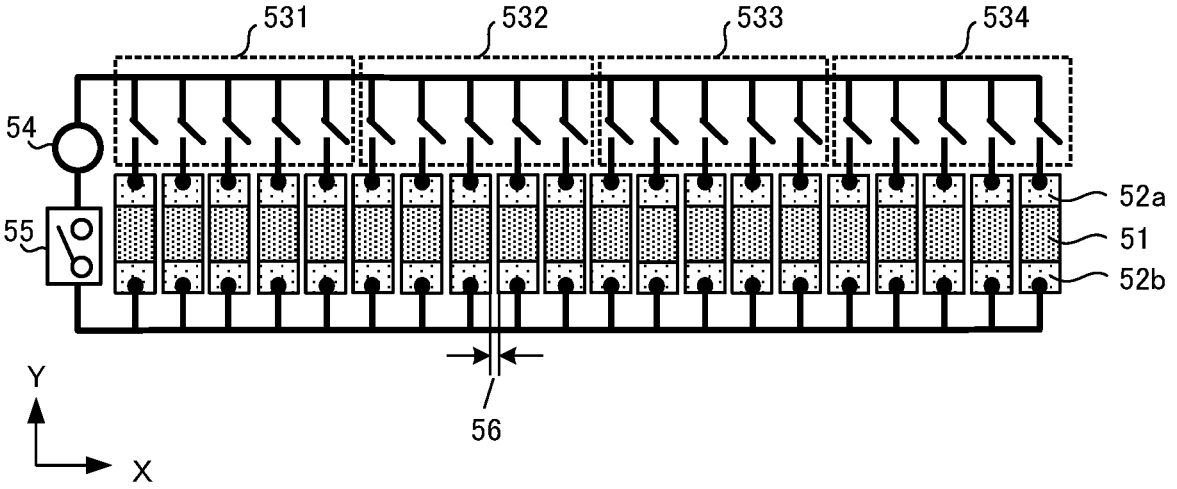
FIG. 6 is an explanatory diagram showing a connection state of a heat generating member group of the heating member shown in FIG. 5 and driving circuits.

FIG. 6 is an explanatory diagram showing a connection state of the heat generating member group of the heating member 46 shown in FIG. 5 and a driving circuit for the heat generating member group. In FIG. 6, the plurality of heat generating members 51 are respectively individually controlled to be energized by a plurality of driving ICs (integrated circuits) 531, 532, 533, and 534. That is, the electrodes 52*a* of the heat generating members 51 are connected to one end of a driving source 54 via the driving ICs 531, 532, 533, and 534. The electrodes 52*b* of the heat generating member 51 are connected to the other end of the driving source 54.

As specific examples of the driving ICs 531 to 534, a switching element formed by an FET, a triac, a switching IC, and the like can be used. Switches of the driving ICs 531 to 534 are turned on, whereby the heat generating members 51 are energized by the driving source 54. Therefore, the driving ICs 531 to 534 configure switching units of the heat generating members 51. As the driving source 54, for example, an AC power supply (AC) and a DC powers supply (DC) can be used. Note that, in the following explanation, the driving ICs 531 to 534 are sometimes collectively referred to as driving ICs 53.

A thermostat 55 may be connected to the driving source 54 in series. The thermostat 55 is turned off if the temperature of the heating member 46 reaches temperature (a dangerous temperature) set in advance. If the thermostat 55 is turned off, the thermostat 55 disconnects the driving source 54 and the heat generating members 51 and prevents the heating member 46 from being abnormally heated.

Figure 7:
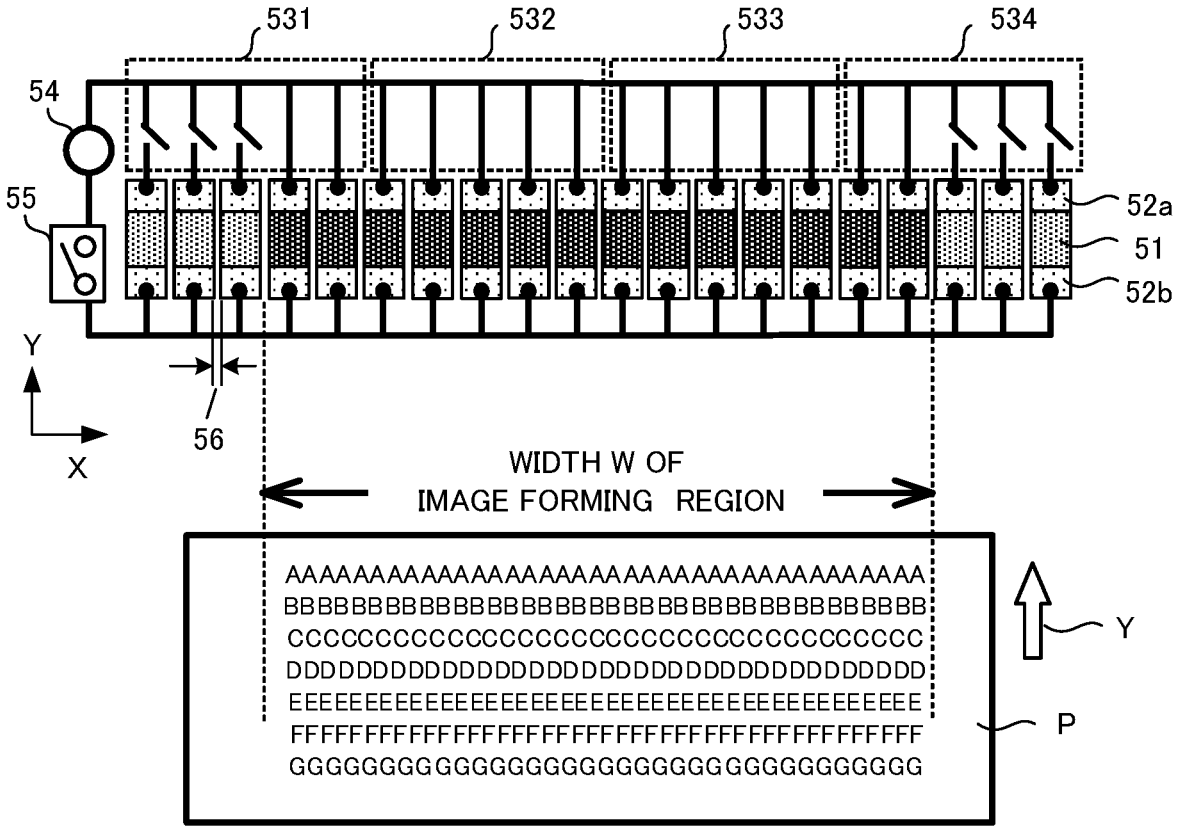
FIG. 7 is an explanatory diagram showing a positional relation between the heat generating member group shown in FIG. 6 and a printing region of a sheet.

FIG. 7 is a diagram for explaining a positional relation between the heat generating member group shown in FIG. 6 and a printing region of a sheet. In FIG. 7, assumed that the sheet P is conveyed in an arrow Y direction. In FIG. 7, a state in shown in which the switch of the driving IC 53 connected to the heat generating member 51 present in a position corresponding to the printing region of the sheet (width W of an image forming region) is selectively turned on and the heat generating member 51 is energized and heated. That is, only the printing region of the sheet P is intensively heated.

Before the sheet P is conveyed into the fixing apparatus 36, the size of the printing region of the sheet P is determined. As a method of determining the printing region of the sheet P, there is a method of using an analysis result of image data read by the scanner unit 15 and image data created by a personal computer or the like. There is also a method of determining the printing region on the basis of printing format information such as margin setting on the sheet P. Further, there is, for example, a method of determining the printing region on the basis of a detection result of an optical sensor.

Figure 8:
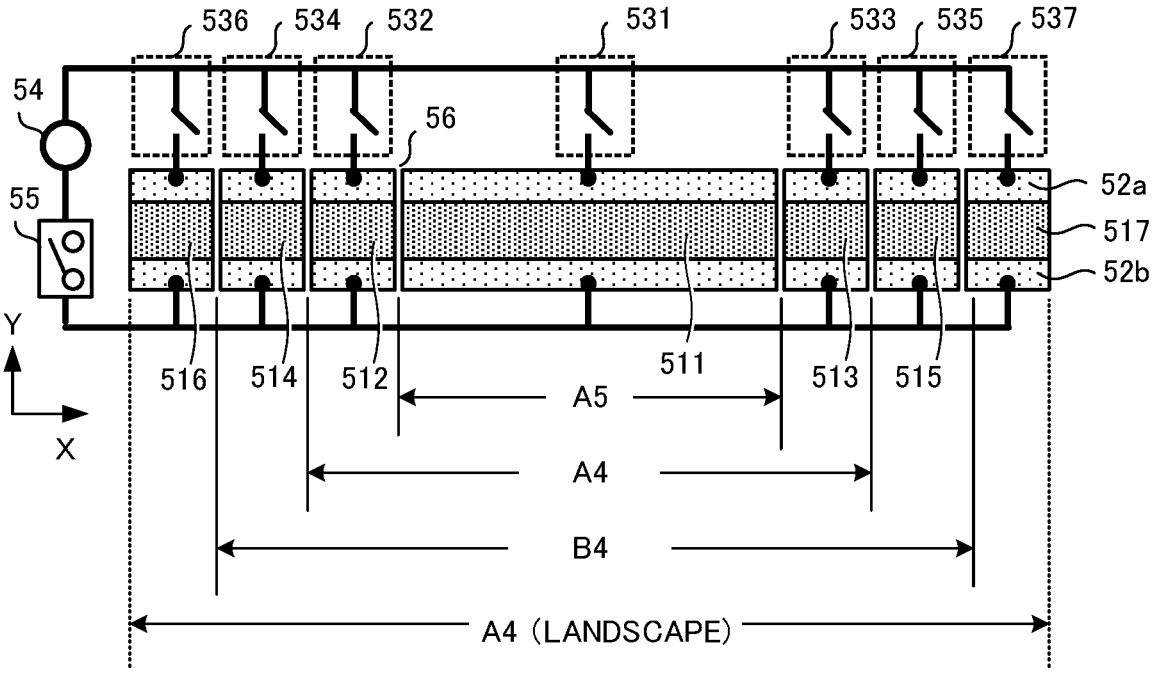
FIG. 8 is a diagram showing another disposition example of the heat generating member group in the first embodiment.

FIG. 8 is a diagram showing another disposition example of the heat generating member group in the first embodiment. There are various sizes of the sheet P conveyed to the fixing apparatus 36. For example, an A5 size (148 mm), an A4 size (210 mm), a B4 size (257 mm), and an A4 landscape size (297 mm) are relatively often used.

Therefore, in FIG. 8, the heat generating members 51 having a plurality of kinds of widths are arrayed in the X direction to correspond to sheet sizes (the four kinds of sizes explained above). The heat generating member group is energized to have a margin of approximately 5% in a heating region taking into account conveyance accuracy and generation of a skew of a conveyed sheet or release of heat to a non-heated portion.

For example, among the four kinds of sizes, a first heat generating member 511 is provided in the center in the X direction to correspond to the width (148 mm) of the A5 size, which is the minimum size. Second heat generating members 512 and 513 are provided on the outer side in the X direction of the first heat generating member 511 to correspond to the width (210 mm) of the A4 size larger than the A5 size. Similarly, third heat generating members 514 and 515 are provided on the outer side of the second heat generating members 512 and 513 to correspond to the width (257 mm) of the B4 size larger than the A4 size. Fourth heat generating members 516 and 517 are provided on the outer side of the third heat generating members 514 and 515 to correspond to the width (297 mm) of the A4 landscape size larger than the B4 size.

The electrodes 52*a* of the heat generating members (511 to 517) are connected to one end of the driving source 54 via the driving ICs 531 to 537. The electrodes 52*b* are connected to the other end of the driving source 54. Note that the number of the heat generating members (511 to 517) and the widths of the heat generating members (511 to 517) shown in FIG. 8 are described as an example and are not limited to the example.

In FIG. 8, the sheet P is conveyed along the center of the conveying path. If the sheet P of the minimum size (A5) is conveyed, only the driving IC 531 connected to the first heat generating member 511 in the center is switched on. As the size of the sheet P increases, the driving ICs (532 to 537) connected to the second to fourth heat generating members (512 to 517) are respectively sequentially switched on.

Figure 9:
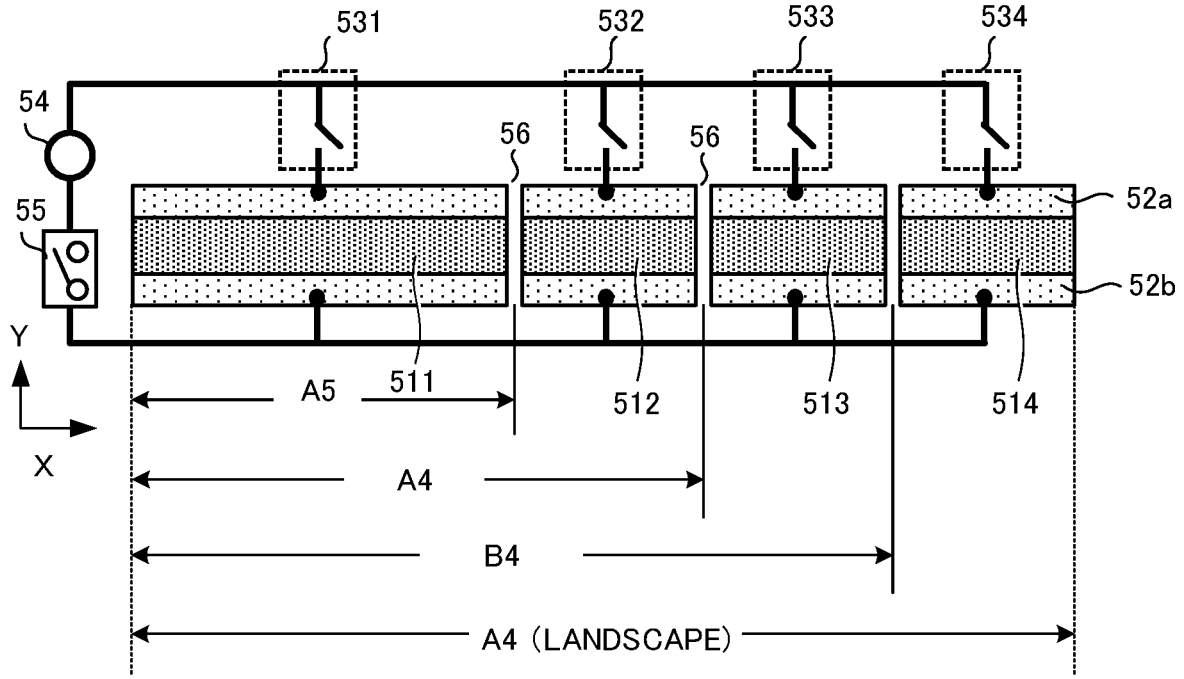
FIG. 9 is a diagram showing still another disposition example of the heat generating member group in the first embodiment.

FIG. 9 is a diagram showing still another disposition example of the heat generating member group in the first embodiment. In FIG. 9, an example is shown in which the sheet P is conveyed along one end portion (e.g., the left side) of the conveying path of the sheet P. As in FIG. 8, the heat generating members 51 having the plurality of kinds of width are arrayed in the X direction to correspond to the four kinds of sheet sizes.

For example, the first heat generating member 511 is provided on the leftmost side in the X direction to correspond to the width of the A5 size, which is the minimum size, among the four kinds of sizes. The second heat generating member 512 is provided on the right side of the heat generating member 511 to correspond to the width of the A4 size larger than the A5 size. Similarly, the third heat generating member 513 is provided on the right side of the second heat generating member 512 to correspond to the width of the B4 size larger than the A4 size. The fourth heat generating member 514 is provided on the right side of the third heat generating member 513 to correspond to the width of the A4 landscape size larger than the B4 size.

The electrodes 52*a* of the heat generating members (511 to 514) are connected to one end of the driving source 54 via the driving ICs 531 to 534. The electrodes 52*b* of the heat generating members (511 to 514) are connected to the other end of the driving source 54. Note that the number of the heat generating members (511 to 514) and the widths of the heat generating members shown in FIG. 9 are described as an example and are not limited to the example.

In FIG. 9, if the sheet P of the minimum size (A5) is conveyed, only the driving IC 531 connected to the first heat generating member 511 on the leftmost side is switched on. As the size of the sheet P increases, the driving ICs (532 to 534) connected to the second to fourth heat generating members (512 to 514) are respectively sequentially switched on.

In this embodiment, a line sensor 40 (see FIG. 1) is disposed in a paper passing region. The line sensor 40 determines a size and a position of a passing sheet on a real-time basis. Alternatively, the line sensor 40 may determine a sheet size during a start of a printing operation from image data or information concerning the paper feeding cassettes 18 in which sheets are stored in the MFP 10.

Incidentally, in the heating member 46 shown in FIGS. 5 and 6, a gap 56 is present between the heat generating members 51 adjacent to each other. Similarly, in the heating member 46 shown in FIGS. 8 and 9, the gap 56 is present between the heat generating members adjacent to each other. This gap 56 portion cannot generate heat. Therefore, a temperature drop occurs in the gap portion. If the temperature drop occurs, heat generation unevenness occurs in a direction orthogonal to a conveying direction Y of a sheet. The heat generation unevenness affects fixing quality. In particular, in the case of color printing, it is likely that differences occur in color development and gloss. Therefore, the temperature of the heating member 46 needs to be equalized.

Therefore, in the heater and the fixing apparatus according to the first embodiment, a ceramic substrate is formed in a multiplayer structure. The plurality of heat generating members 51 are arrayed in the X direction on a first surface (a first layer) of the ceramic substrate. A heat radiating body that actively or passively generates heat (radiates stored heat) is disposed on a second surface (a second layer) to compensate for gaps among the plurality of heat generating members 51.

That is, the heat radiating body disposed on the second surface corresponding to gap portions among the plurality of heat generating members.

Figure 10A:
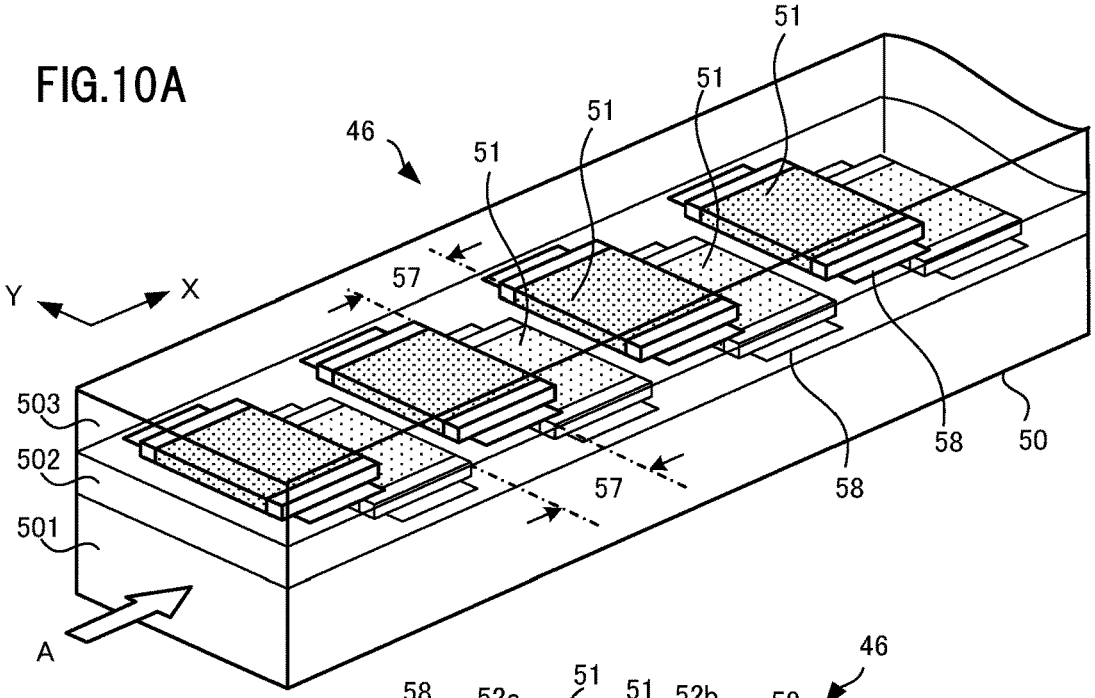
FIGS. 10A to 10D are a perspective view, a sectional view, and schematic sectional views showing the configuration of the heating member in the first embodiment.

FIGS. 10A to 10D are diagrams showing the configuration of the heating member 46 (the heater) according to the first embodiment. FIG. 10A is a perspective view. The heating member 46 shown in FIG. 10A corresponds to an example in which the plurality of heat generating members 51 having fixed width are arrayed in the X direction as shown in FIG. 5.

As shown in FIG. 10A, the ceramic substrate 50, which is the heat-resistant insulating substrate, is formed in a multilayer structure including a ceramic substrate 501 of a first layer and a ceramic substrate 502 of a second layer. Note that the ceramic substrate 501 of the first layer forms a layer configuring a main body portion in the ceramic substrate 50, that is, a base layer.

A heat generation resistance layer is directly stacked on a first surface (e.g., the ceramic substrate 501 of the first layer) of the ceramic substrate 50. A heat generation resistance layer is directly stacked on a second surface (e.g., the ceramic substrate 502 of the second layer) of the ceramic substrate 50. The heat generation resistance layers configure the heat generating members 51. The heat generating members 51 are formed of a known material such as $TaSiO_2$. Alternatively, the heat generating members 51 may be configured by stacking glaze layers and heat generation resistance layers on the ceramic substrates 501 and 502. The plurality of heat generating members 51 on the second surface are members for temperature equalization and configure a heat radiating body that actively radiates stored heat.

The heat generating members 51 on the ceramic substrate 501 of the first layer are arrayed in the longitudinal direction (the X direction) of the ceramic substrate 501 with predetermined gaps 57 apart from one another. The heat generating members 51 on the ceramic substrate 502 of the second layer are also arrayed in the longitudinal direction (the X direction) of the ceramic substrate 502 with the predetermined gaps 57 apart from one another.

However, the heat generating members 51 disposed on the second layer are disposed to compensate for the gaps 57 among the heat generating members 51 of the first layer. That is, the heat generating members 51 of the first layer and the heat generating members 51 of the second layer are alternately disposed in the vertical direction. The end portions in the X direction of the heat generating members 51 of the first layer and the heat generating members 51 of the second layer overlap each other.

Therefore, if the heating member 46 is viewed from right above the figure, the heat generating members 51 are disposed in the X direction without a gap and can be controlled to uniform temperature. Further, a protecting layer 503 may be provided on the ceramic substrate 502 of the second layer. The protecting layer 503 is made of a material different from the ceramic substrate. The protecting layer 503 is formed of, for example, $Si_3N_4$ to cover the heat generating members 51.

Figure 10B:
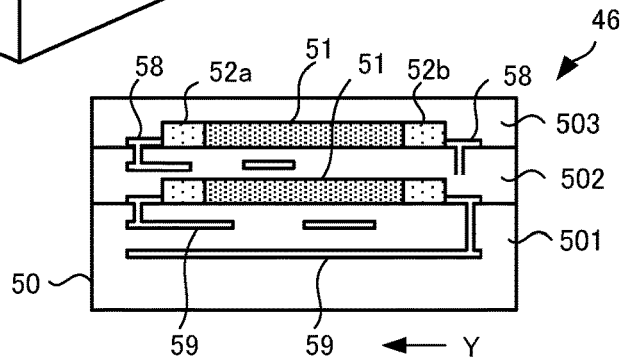

FIG. 10B is a sectional view of the heating member 46 viewed from an arrow A direction of FIG. 10A. As shown in FIG. 10B, the heat generating members 51 are formed in multiple layers on the ceramic substrates 501 and 502. A method of forming the heat generating members 51 (the heat generation resistance layers) is the same as a known method (e.g., a method of forming a thermal head). A masking layer is formed of aluminum on the heat generation resistance layers. In heat generating members adjacent to each other are insulated. Aluminum layers (the electrodes 52*a* and 52*b*) are formed in a pattern in which the heat generating members 51 are exposed in the Y direction.

Electric conductors 58 for wiring are connected to the aluminum layers (the electrodes 52*a* and 52*b*) at both ends of the heat generating members 51. The electric conductors 58 are connected to, by through-hole patterns (silver paste is filled in through-holes), wiring patterns 59 formed on the ceramic substrates 501 and 502 by screen printing or the like. The wiring patterns 59 are respectively joined to the switching elements of the driving ICs 53. Therefore, power feed to the heat generating members 51 is performed from the driving source 54 via the wiring patterns 59, the electric conductors 58, and the switching elements of the driving ICs 53.

Further, the protecting layer 503 is formed in a top section to cover all of the heat generating members 51, the aluminum layers (the electrodes 52*a* and 52*b*), the electric conductors 58, and the like on the ceramic substrate 502 of the second layer. AC or DC is supplied to the heat generating member group from the driving source 54. Note that the switching elements (triacs or FETs) of the driving ICs are desirably switched by a zero-cross circuit to take into account flicker.

Figure 10C:
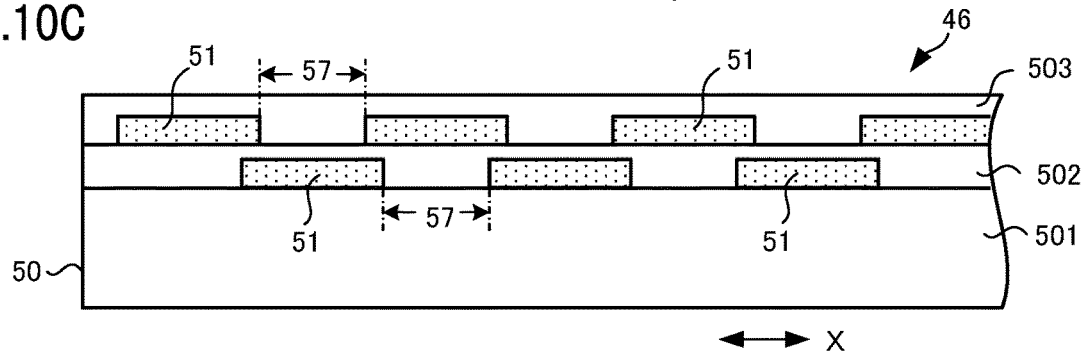

FIG. 10C is a schematic sectional view of the heating member 46 viewed from the Y direction. As it is seen from FIG. 10C, the heat generating members 51 are arrayed on the ceramic substrate 501 of the first layer and the ceramic substrate 502 of the second layer. The heat generating members 51 of the first layer are arrayed in the X direction of the ceramic substrate 501 with the gaps 57 having the predetermined width apart from one another. The heat generating members 51 of the second layer are arrayed with the gaps 57 having the predetermined width apart from one another to compensate for the gaps 57 of the first layer.

The heat generating members 51 of the first layer and the heat generating members 51 of the second layer are alternately disposed in the vertical direction. The end portions in the X direction of the heat generating members 51 of the first layer and the heat generating members 51 of the second layer overlap each other. Therefore, if the heating member 46 is viewed from right above the figure, the heat generating members 51 are disposed in the X direction without a gap and can be controlled to uniform temperature.

Figure 10D:
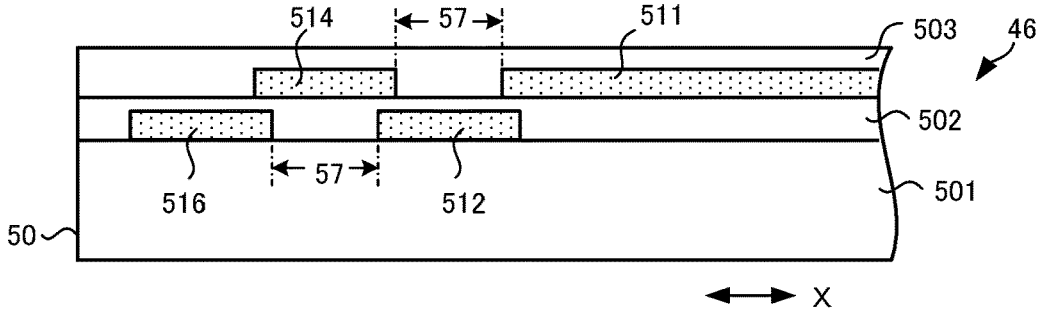

FIG. 10D is a schematic sectional view showing another example of the heating member 46. The heating member 46 of FIG. 10D corresponds to the example shown in FIG. 8. In FIG. 10D, only the heat generating members 511, 512, 514, and 516 are shown. The heat generating members 511, 513, 515, and 517 are symmetrical to the disposition of the heat generating members 511, 512, 514, and 516. Illustration of the heat generating members 511, 513, 515, and 517 is omitted.

In the example shown in FIG. 10D, the heat generating members 516 and 512 on the ceramic substrate 501 of the first layer are arrayed in the X direction on the ceramic substrate 501 with the gap 57 having the predetermined width apart from each other. The heat generating members 514 and 511 on the ceramic substrate 502 of the second layer are disposed with the gap 57 having the predetermined width apart from each other to compensate for the gap 57 of the first layer.

The heat generating members (516 and 512) of the first layer and the heat generating members (514 and 511) of the second layer are alternately disposed in the vertical direction. Both the end portions in the X direction of the heat generating members of the first layer overlap both the end portions in the X direction of the heat generating members of the second layer. Therefore, if the heating member 46 is viewed from right above the figure, the heat generating members 51 are disposed in the X direction without a gap and can be controlled to uniform temperature.

By equalizing the temperature of the heating member 46, possible to reduce temperature unevenness of the fixing belt 41 and achieve temperature equalization. Therefore, toner uniformly adheres during image formation, color unevenness decreases, and the quality of an image can be improved.

Note that the heating member 46 shown in FIG. 10D corresponds to the example shown in FIG. 8. However, the heating member 46 can also be configured to correspond to the example shown in FIG. 9. That is, the heat generating members 511 and 513 shown in FIG. 9 may be disposed on the ceramic substrate 501 with the gap 57 apart from each other. The heat generating members 512 and 514 may be disposed on the ceramic substrate 502 with the gap 57 apart from each other. In this case, both the end portions in the X direction of the heat generating members of the first layer are also arrayed to overlap both the end portions in the X direction of the heat generating members of the second layer.

It is possible to further achieve the temperature equalization if the heat generating members on the first surface (the first layer) and the heat generating members on the second surface (the second layer) are set such that a heat generation amount of the heat generating members of a layer (the first layer) far from the surface of the ceramic substrate 50 (a position where the heating member 46 is in contact with the fixing belt 41) is large.

That is, if the heating member 46 is set in contact with the fixing belt 41, the ceramic substrate 501 of the first layer forming the base layer of the ceramic substrate 50 is located at a distance away from the fixing belt 41. Therefore, a heat generation amount of the heat generating members 51 of the first layer is set larger than a heat generation amount of the heat generating members 51 of the second layer closer to the fixing belt 41. Therefore, a heat generation amount in the longitudinal direction of the heating member 46 in contact with the fixing belt 41 is substantially uniform. It is possible to heat the fixing belt 41 at uniform temperature.

To increase a heat generation amount of the heat generating members in a layer far from the position in contact with the fixing belt 41, a heat generation resistance layer made of a different material is desirably used. Alternatively, to increase the heat generation amount, a heat generation resistance layer having large thickness is desirably formed of the same material. If viewed from the surface of the ceramic substrate 50, the length in the Y direction of the heat generating member of the far layer may be reduced.

In this way, the heating member 46 sets the heat generation amount of the heat generating members on the first surface and the heat generation amount of the heat generating members (the heat radiating body) on the second surface to be different. That is, possible to further achieve the temperature equalization by setting the heat generation amount of the heat generating members 51 present in the layer (the first layer) far from the contact position (a nip) with the fixing belt 41 to be larger than the heat generation amount of the heat generating members 51 present in the layer (the second layer) close to the contact position.

Figure 11A:
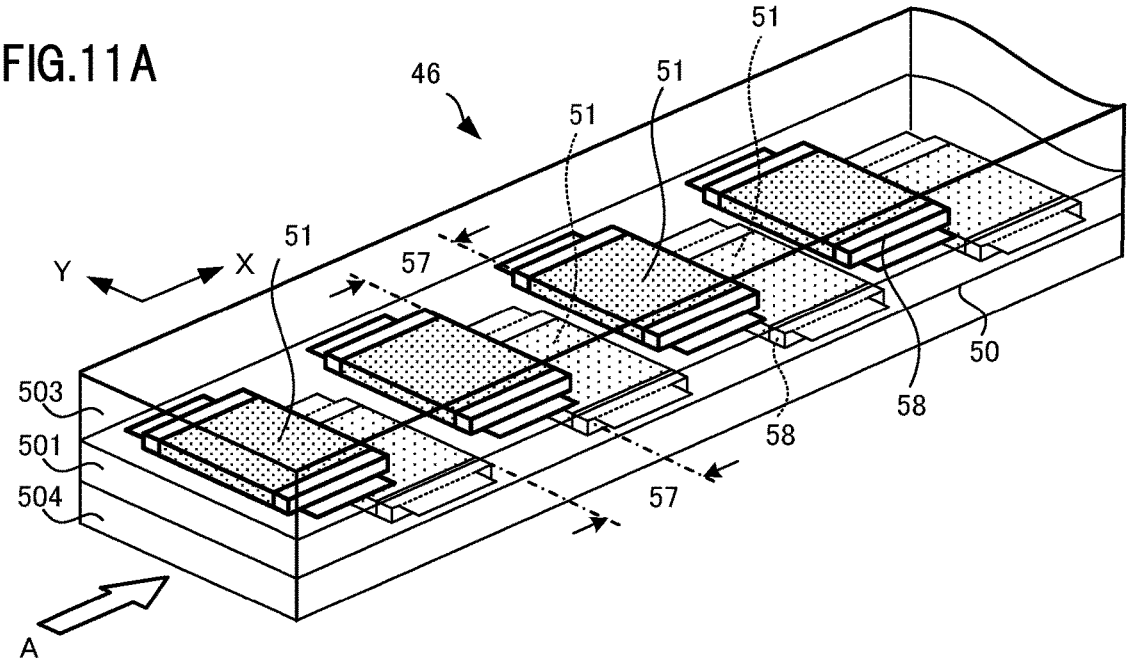
FIGS. 11A to 11D are a perspective view, a sectional view, and schematic sectional views showing another configuration of the heating member in the first embodiment.

FIGS. 11A to 11D are diagrams showing another configuration of the heating member 46 (the heater) according to the first embodiment. FIG. 11A is a perspective view. In the heating member 46, pluralities of heat generating members 51 having fixed width are arrayed in the X direction on both surfaces of a single insulating substrate (e.g., the ceramic substrate 501). Note that, in FIGS. 11A to 11D, a surface on the upper side of the ceramic substrate 501 is assumed to be a front surface and a surface on the lower surface is assumed to be a rear surface.

Heat generation resistance layers are respectively directly stacked and formed on the rear surface (the first surface) and the front surface (the second surface) of the ceramic substrate 501. Alternatively, glaze layers and heat generation resistance layers may be stacked and formed on the rear surface and the front surface of the ceramic substrate 501. The heat generation resistance layers configure the heat generating members 51 and are formed of a known material such as $TaSiO_2$.

The heat generating members 51 formed on the rear surface (the first surface) of the ceramic substrate 501 are arrayed in the longitudinal direction (the X direction) with the predetermined gaps 57 apart from one another. The heat generating members 51 formed on the front surface (the second surface) of the ceramic substrate 501 are also arrayed in the longitudinal direction (the X direction) with the predetermined gaps 57 apart from one another. However, the heat generating members 51 disposed on the front surface are disposed to compensate for the gaps 57 among the heat generating members 51 on the rear surface. The end portions in the X direction of the heat generating members 51 disposed on the rear surface and the heat generating members 51 disposed on the front surface overlap each other.

Therefore, if the heating member 46 is viewed from right above the figure, the heat generating members 51 are disposed in the X direction without a gap and can be controlled to uniform temperature. Further, the protecting layer 503 may be provided on the upper surface side of the ceramic substrate 501. A protecting layer 504 may be provided on the lower surface side. The protecting layers 503 and 504 are formed of, for example, $Si_3N_4$.

Figure 11B:
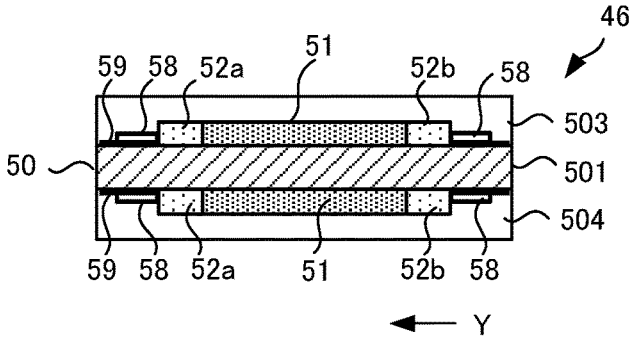

FIG. 11B is a sectional view of the heating member 46 viewed from an arrow A direction in FIG. 11A. As shown in FIG. 11B, the heat generating members 51 are formed on both the surfaces of the ceramic substrate 501. The aluminum layers (the electrodes 52*a* and 52*b*) are formed in a pattern in which the heat generating members 51 are exposed in the Y direction.

The electric conductors 58 for wiring are connected to the electrodes 52*a* and 52*b* at both ends of the heat generating members 51. The electric conductors 58 are connected to wiring patterns 59 formed on the ceramic substrate 501 by screen printing or the like. The wiring patterns 59 are respectively joined to the switching elements of the driving ICs 53.

In FIGS. 11A to 11D, since the disposition of the heat generating members 51 is mainly explained, details of the wiring patterns 59 are omitted. However, if the width in the Y direction of the ceramic substrate 50 is increased, a space for forming the wiring patterns 59 can be secured. In this way, power feed to the heat generating members 51 is performed from the driving source 54 via the wiring patterns 59, the electric conductors 58, and the switching elements of the driving ICs 53.

Figure 11C:
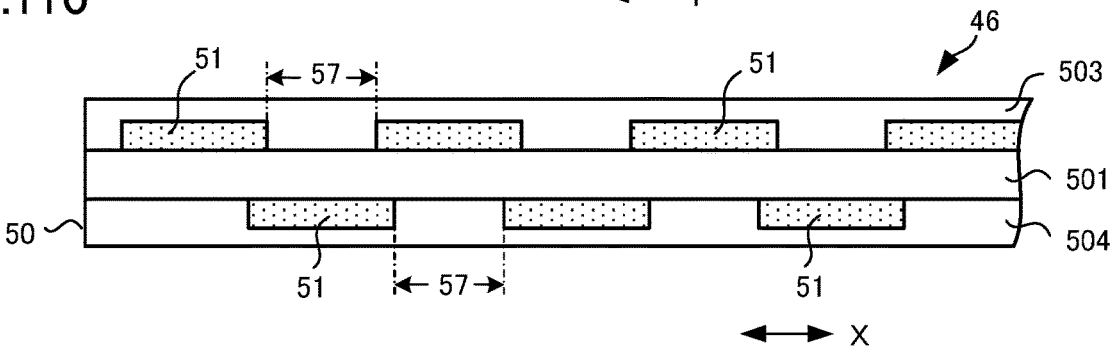

FIG. 11C is a schematic sectional view of the heating member 46 viewed from the Y direction. The heat generating members 51 on the rear surface side of the ceramic substrate 501 are arrayed in the X direction with the gaps 57 having the predetermined width apart from one another. The heat generating members 51 on the front surface side are arrayed with the gaps 57 having the predetermined with apart from one another to compensate for the gaps 57 on the rear surface side.

The heat generating members 51 on the rear surface side and the heat generating members 51 on the front surface side are alternately disposed in the vertical direction. The end portions in the X direction of the respective heat generating members 51 overlap each other. Therefore, if the heating member 46 is viewed from right above the figure, the heat generating members 51 are disposed in the X direction without a gap. Therefore, possible to control the heating member 46 to uniform temperature.

Figure 11D:
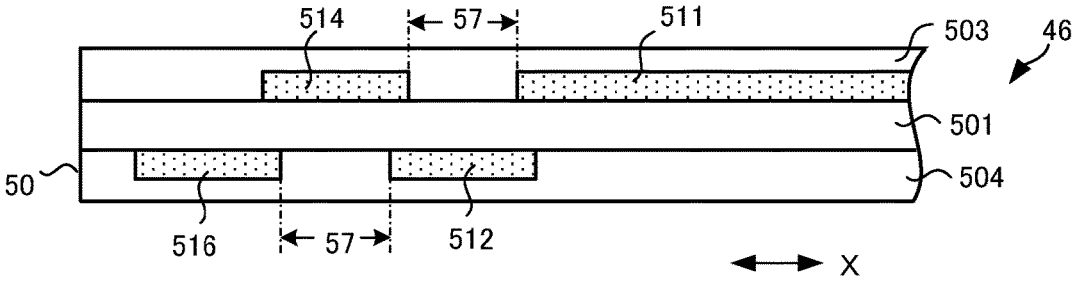

FIG. 11D is a schematic sectional view showing another example of the heating member 46. The heating member 46 shown in FIG. 11D corresponds to the example shown in FIG. 8. In FIG. 11D, only the heat generating members 511, 512, 514, and 516 are shown. The heat generating members 511, 513, 515, and 517 are symmetrical to the disposition of the heat generating members 511, 512, 514, and 516. Illustration of the heat generating members 511, 513, 515, and 517 is omitted.

In the example shown in FIG. 11D, the heat generating members 516 and 512 are arrayed in the X direction with the gap 57 having the predetermined width apart from each other on the rear surface side of the ceramic substrate 501. The heat generating members 514 and 511 are arrayed in the X direction with the gap 57 having the predetermined with apart from each other on the front surface side of the ceramic substrate 501 to compensate for the gap 57. The heat generating members (516 and 512) on the rear surface side and the heat generating members (514 and 511) on the front surface side are alternately disposed in the vertical direction. Both the end portions in the X direction of the respective heat generating members overlap.

Therefore, if the heating member 46 is viewed from right above the figure, the heat generating members 51 are disposed in the X direction without a gap. Therefore, possible to control the heating member 46 to uniform temperature. By equalizing the temperature of the heating member 46, possible to reduce temperature unevenness of the fixing belt 41 and achieve temperature equalization and improve quality during image formation.

Note that the heat generating members on the first surface (the rear surface) and the heat generating members on the second surface (the front surface) are desirably set such that a heat generation amount of the heat generating members on the surface (the rear surface) far from the surface of the ceramic substrate 501 (a position where the heating member 46 is in contact with the fixing belt 41) is large. As a result, possible to further equalize the temperature of the heating member 46.

Note that the heating member 46 shown in FIG. 11D corresponds to the example shown in FIG. 8. However, the heating member 46 can also be configured to correspond to the example shown in FIG. 9. That is, the heat generating members 511 and 513 shown in FIG. 9 are disposed with the gap 57 apart from each other on the first surface (e.g., the rear surface) of the ceramic substrate 501. The heat generating members 512 and 514 are disposed with the gap 57 apart from each other on the second surface (e.g., the front surface) to compensate for the gap 57. In this case, both the end portions in the X direction of the heat generating members on the first surface are arrayed to overlap both the end portions in the X direction of the heat generating members on the second surface.

Figure 12A:
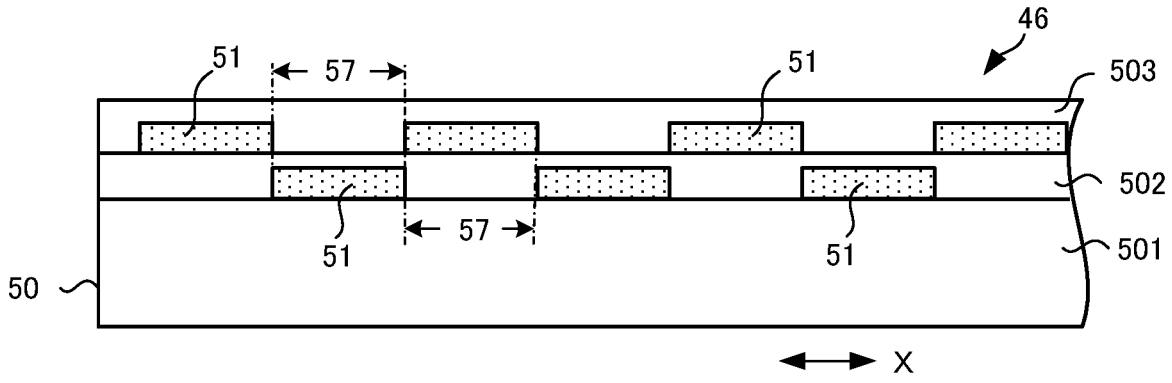
FIGS. 12A and 12B are schematic sectional views showing still another configuration of the heating member in the first embodiment.
Figure 12B:
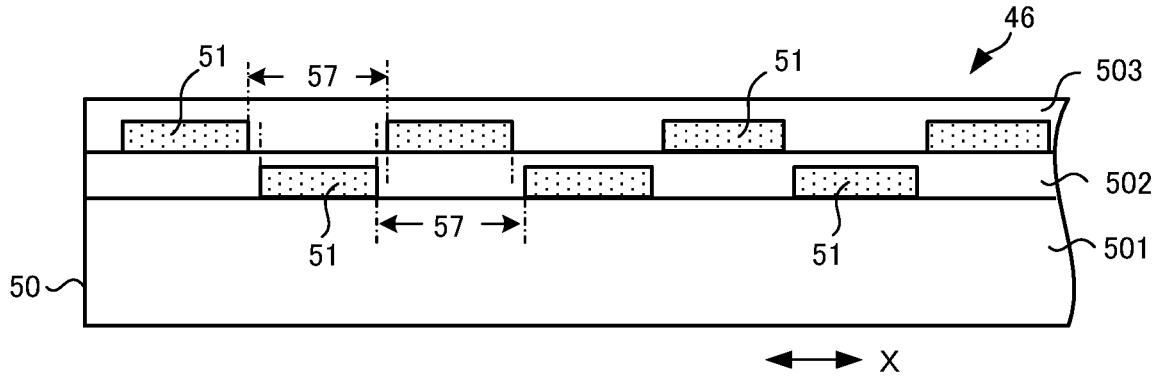

FIGS. 12A and 12B are schematic sectional views showing another modification of the heating member 46. FIGS. 12A and 12B are a modification of the array of the heat generating member 51 of the first layer and the heat generating members 51 of the second layer shown in FIG. 10C. As shown in FIG. 12A, the heat generating members 51 are arrayed on the ceramic substrates 501 and 502 of the first layer and the second layer. The heat generating members 51 of the first layer are arrayed in the X direction of the ceramic substrate 501 with the gaps 57 having the predetermined width apart from one another. The heat generating members 51 in the second layer are arrayed with the gaps 57 having the predetermined with apart from one another to compensate for the gaps 57 of the first layer.

The heat generating members 51 of the first layer and the heat generating members 51 of the second layer are alternately disposed in the vertical direction. However, the heat generating members 51 of the first layer and the heat generating members 51 of the second layer coincide with the gaps 57 opposed thereto without the end portions in the X direction thereof overlapping. That is, the gaps 57 are set to coincide with the width in the X direction of the heat generating members 51 of the first layer and the heat generating members 51 of the second layer.

Therefore, if the heating member 46 is viewed from right above the figure, the heat generating members 51 are disposed in the X direction without a gap and can be controlled to uniform temperature. As shown in FIG. 10C, the heat generating members 51 of the first layer and the heat generating members 51 of the second layer do not overlap. However, the gaps 57 of the first layer are compensated by the heat generating members 51 of the second layer. Therefore, possible to suppress a temperature drop of the gap 57 portions.

FIG. 12B is still another modification of the heating member 46. The heat generating members 51 are arrayed in the X direction with the gaps 57 having the predetermined width apart from one another respectively on the ceramic substrates 501 and 502 of the first layer and the second layer. The heat generating members 51 of the first layer and the heat generating members 51 of the second layer are alternately disposed in the vertical direction.

However, the end portions in the X direction of the heat generating members 51 of the first layer and the heat generating members 51 of the second layer do not overlap. The gaps 57 are set lightly larger than the width in the X direction of the heat generating members 51 of the first layer and the second layer. Therefore, if the heating member 46 is viewed from right above the figure, the heat generating members 51 are disposed in the X direction with a few gaps.

In the example shown in FIG. 12B, the end portions of the heat generating members 51 of the first layer and the second layer do not overlap unlike the end portions shown in FIG. 10D. However, since most of the gaps 57 of the first layer are compensated by the heat generating members 51 of the second layer, there is an effect of suppressing a temperature drop of the gap 57 portions.

Note that the configuration in which the heat generating members 51 of the first layer and the heat generating members 51 of the second layer do not overlap can be applied to the heating member 46 shown in FIGS. 8 and 9. Similarly, the configuration can also be applied to the heating member 46 formed on the ceramic substrate 501 having a single layer structure shown in FIGS. 11A to 11D.

As explained above, with the heater and the fixing apparatus according to the first embodiment, in the plurality of heat generating members in the heating member 46 (the heater), insulation among the heat generating members is secured and occurrence of temperature unevenness can be reduced.

Note that, in the first embodiment, ceramics is explained as the example of the heat-resistant insulating substrate.

However, it is evident that the same effect is obtained with a heat-resistant insulating substrate such as a glass epoxy substrate or a glass composite substrate. A higher layer in an upper part of a heat generation resistance layer may be made of $SiO_2$.

Second Embodiment

A heater and a fixing apparatus according to a second embodiment are explained. In the heating member 46 in the second embodiment, a ceramic substrate is formed in, for example, a multilayer structure and a plurality of heat generating members 51 are arrayed in the X direction on a first surface of the ceramic substrate (on the ceramic substrate of the first layer). A plurality of good heat conductors 60 are arrayed on a second surface (on the ceramic substrate of the second layer) to compensate for gaps among the plurality of heat generating members. The plurality of good heat conductors 60 on the second surface are members for temperature equalization and configure a heat radiating body that passively generates heat (radiates stored heat).

Figure 13A:
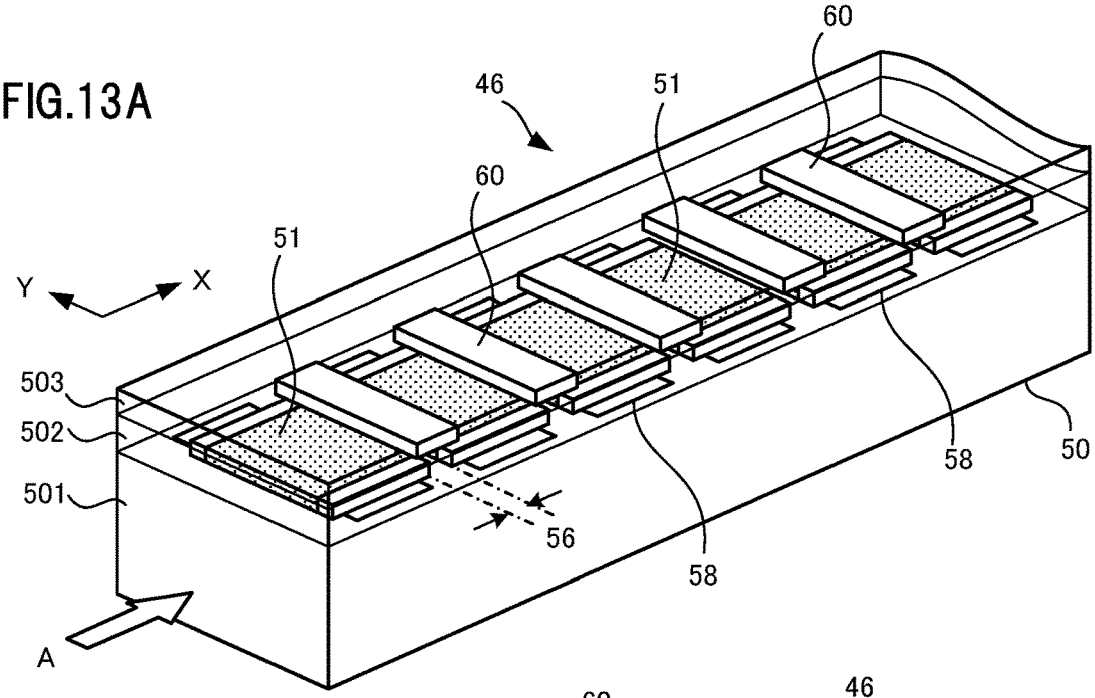
FIGS. 13A to 13D are a perspective view, a sectional view, and schematic sectional views showing the configuration of a heating member in a second embodiment.

FIGS. 13A to 13D are diagrams showing the configuration of the heating member 46 according to the second embodiment. FIG. 13A is a perspective view. The heating member 46 shown in FIG. 13A corresponds to the example in which the heat generating members 51 having the fixed width are arrayed in the X direction as shown in FIG. 5.

As shown in FIG. 13A, the ceramic substrate 50, which is the heat-resistant insulating substrate, is formed in a multilayer structure including the ceramic substrate 501 of the first layer and the ceramic substrate 502 of the second layer. A heat generation resistance layer is directly stacked on the ceramic substrate 501 of the first layer. Alternatively, a glaze layer and a heat generation resistance layer are stacked on the ceramic substrate 501 of the first layer. The heat generating resistance layer configures the heat generating members 51. The heat generating members 51 are formed on a known material such as $TaSiO_2$.

The good heat conductors 60 are arrayed on the ceramic substrate 502 of the second layer with predetermined gaps apart from one another to compensate for gap 56 portions among the heat generating members 51 on the ceramic substrate 501 of the first layer. The good heat conductors 60 are members for temperature equalization made of a metal layer of aluminum, copper, or the like. The good heat conductors 60 receive the heat of the heat generating members 51 of the first layer to generate heat. That is, the good heat conductors 60 configure a heat radiating body that passively radiates stored heat. The end portions in the X direction of the heat generating members 51 of the first layer and the good heat conductors 60 of the second layer overlap each other.

Therefore, if the heating member 46 is viewed from right above the figure, the heat generating members 51 are disposed in the X direction such that the gaps 56 are hidden by the good heat conductors 60. The heat of the heat generating members 51 is transmitted to the good heat conductors 60 to reduce a temperature drop in the gap 56 portions. Consequently, possible to control the heating member 46 to uniform temperature. Further, the protecting layer 503 may be provided on the ceramic substrate 502 of the second layer. The protecting layer 503 is formed of, for example, $Si_3N_4$ or $SiO_2$.

Figure 13B:
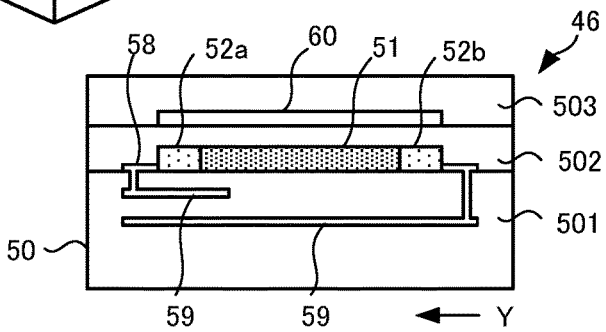

FIG. 13B is a sectional view of the heating member 46 viewed from an arrow A direction in FIG. 13A. As shown in FIG. 13B, the heat generating member 51 is formed on the ceramic substrate 501. A method of forming the heat generating member 51 (the heat generation resistance layer) is the same as an existing method (e.g., a method of forming a thermal head). A masking layer is formed of aluminum on the heat generation resistance layer. The heat generating members adjacent to one another are insulated. The aluminum layers (the electrodes 52*a* and 52*b*) are formed in a pattern in which the heat generating members 51 are exposed in the Y direction.

The electric conductors 58 for wiring are connected to the aluminum layers (the electrodes 52*a* and 52*b*) at both ends of the heat generating members 51. The electric conductors 58 are connected to, by through-hole patterns, wiring patterns 59 formed on the ceramic substrate 501 by screen printing or the like. The wiring patterns 59 are respectively joined to the switching elements of the driving ICs 53. Therefore, power feed to the heat generating members 51 is performed from the driving source 54 via the wiring patterns 59, the electric conductors 58, and the switching elements of the driving ICs 53.

The good heat conductors 60 are arrayed with predetermined gaps apart from one another on the ceramic substrate 502 of the second layer to compensate for the gap 56 portions among the heat generating members 51 on the ceramic substrate 501 of the first layer. Further, the protecting layer 503 is formed in a top section to cover all of the good heat conductors 60 and the like on the ceramic substrate 502 of the second layer.

Figure 13C:
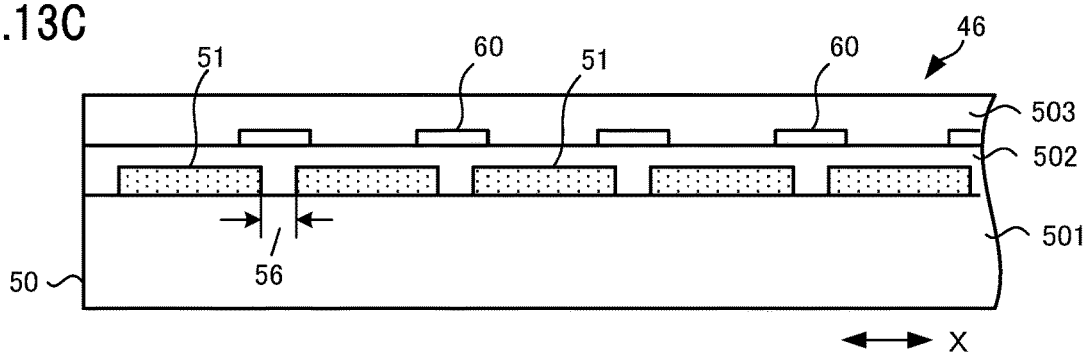

FIG. 13C is a schematic sectional view of the heating member 46 viewed from the Y direction. As it is seen from FIG. 13C, the heat generating members 51 and the good heat conductors 60 are respectively disposed on the ceramic substrates 501 and 502 of the first layer and the second layer. The heat generating members 51 on the ceramic substrate 501 of the first layer are arrayed in the X direction of the ceramic substrate 501 with the gaps 56 having the predetermined width apart from one another.

The good heat conductors 60 arrayed in the second layer are arrayed with predetermined gaps apart from one another to compensate for the gaps 56 of the first layer. The end portions in the X direction of the heat generating members 51 of the first layer and the good heat conductors 60 of the second layer overlap each other. Therefore, if the heating member 46 is viewed from right above the figure, the heat generating members 51 are disposed such that the gaps 56 are hidden by the good heat conductors 60. It is possible to reduce a temperature drop in the gap 56 portions by transferring the heat of the heat generating members 51 to the good heat conductors 60. Therefore, possible to control the heating member 46 to uniform temperature.

Figure 13D:
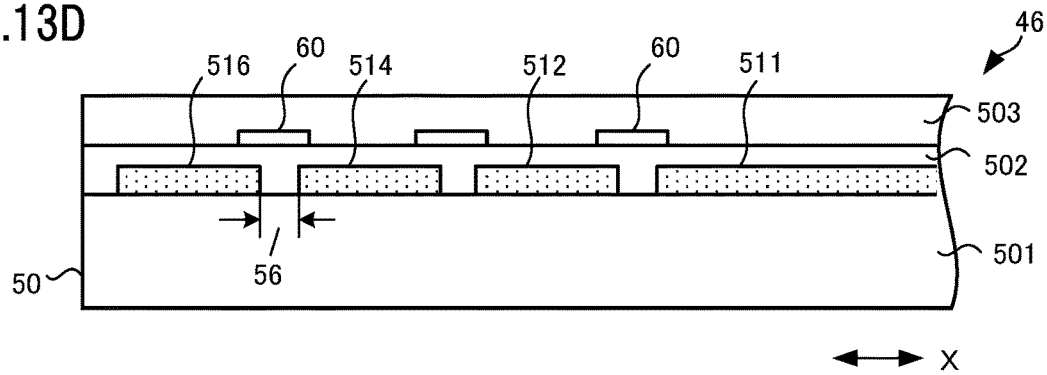

FIG. 13D is a schematic sectional view showing another example of the heating member 46. The heating member 46 shown in FIG. 13D corresponds to the example shown in FIG. 8. In FIG. 13D, only the heat generating members 511, 512, 514, and 516 are shown. The heat generating members 511, 513, 515, and 517 are symmetrical to the disposition of the heat generating members 511, 512, 514, and 516. Illustration of the heat generating members 511, 513, 515, and 517 is omitted.

In the example shown in FIG. 13D, the heat generating members 511, 512, 514, and 516 on the ceramic substrate 501 of the first layer are arrayed in the X direction of the ceramic substrate 501 with the gaps 56 having the predetermined width apart from one another. The good heat conductors 60 arrayed on the ceramic substrate 502 of the second layer are arrayed to compensate for the gaps 56 of the first layer.

The end portions in the X direction of the heat generating members 511, 512, 514, and 516 of the first layer and the good heat conductors 60 of the second layer overlap each other. Therefore, the heat generating members 51 are disposed in the X direction such that the gaps 56 are hidden by the good heat conductors 60. It is possible to reduce a temperature drop in the gap 56 portions by transferring the heat of the heat generating members 51 to the good heat conductors 60.

With the fixing apparatus according to the embodiment shown in FIGS. 13A to 13D, in the plurality of heat generating members 51 in the heating member 46, insulation among the heat generating members is secured. The good heat conductors 60 present in the gap 56 portions receive the heat from the heat generating members 51 and passively generate heat to reduce a temperature drop in the gap 56 portions. Therefore, possible to reduce occurrence of temperature unevenness of the heating member 46.

The heat generated by the heating member 46 is diffused by a substrate, an elastic layer, a surface protecting layer, and the like of the fixing belt 41. Therefore, the good heat conductors 60 are desirably disposed to extend across the gap 56 portions among the heat generating members 51.

In the second embodiment, heat generation in a portion equivalent to an image size is explained. However, it is also possible to segment the heater and heat only a place where an image is present or heat a place where a temperature difference is partially present because of some reasons while correcting the temperature difference.

Figure 14A:
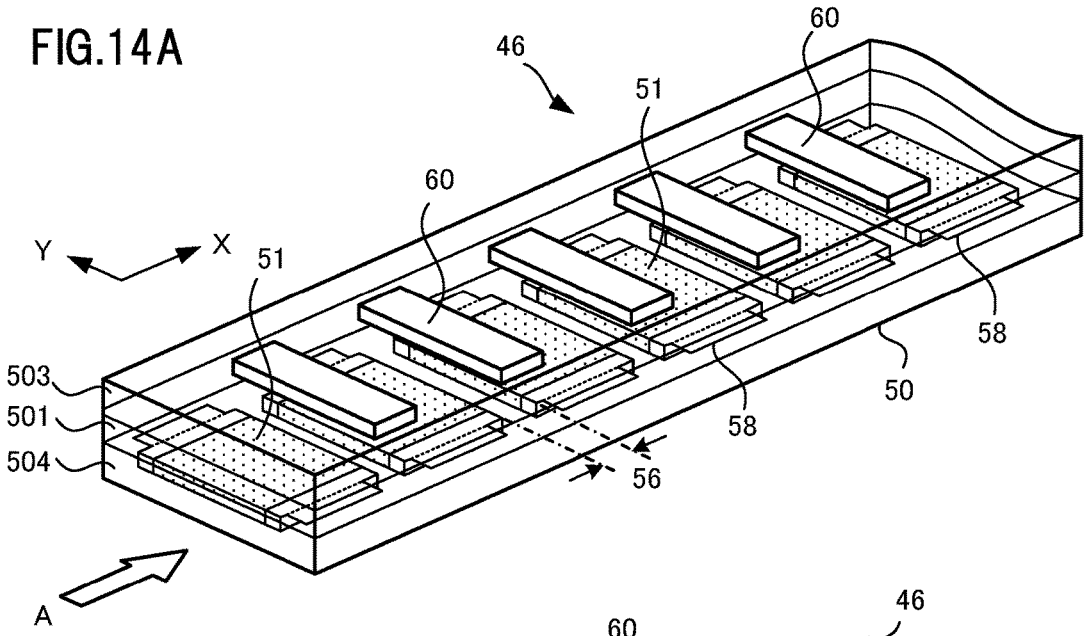
FIGS. 14A to 14D are a perspective view, a sectional view, and schematic sectional views showing another configuration of the heating member in the second embodiment.

FIGS. 14A to 14D are diagrams showing a configuration of a modification of the heating member 46 according to the second embodiment. FIG. 14A is a perspective view. In the heating member 46 shown in FIG. 14A, the plurality of heat generating members 51 are arrayed in the X direction on the first surface (the rear surface) of a single insulating substrate (e.g., the ceramic substrate 501) and the good heat conductors 60 are arrayed in the X direction on the second surface (the front surface).

As shown in FIG. 14A, a heat generation resistance layer is directly stacked and formed on the rear surface of the ceramic substrate 501. Alternatively, a glaze layer and a heat generation resistance layer are stacked and formed on the rear surface of the ceramic substrate 501. The heat generation resistance layer configures the heat generating members 51. The heat generating members 51 are formed of a known material such as $TaSiO_2$. The heat generating members 51 are arrayed in the longitudinal direction (the X direction) with the predetermined gaps 56 apart from one another.

The good heat conductors 60 are arrayed with predetermined gaps apart from one another on the surface of the ceramic substrate 501 to compensate for the gap 56 portions among the heat generating members 51 formed on the rear surface. The good heat conductors 60 are metal layers of aluminum or copper. The heat generating members 51 on the rear surface of the ceramic substrate 501 and the good heat conductors 60 on the front surface are arrayed such that the end portions in the X direction overlap each other.

Therefore, if the heating member 46 is viewed from right above the figure, the heat generating members 51 are disposed in the X direction such that the gaps 56 are hidden by the good heat conductors 60. A temperature drop in the gap 56 portions is reduced by transferring the heat of the heat generating members 51 to the good heat conductors 60. Consequently, possible to control the heating member 46 to uniform temperature.

Further, the protecting layer 503 may be provided on the front surface of the ceramic substrate 501 and the protecting layer 504 may be provided on the rear surface. The protecting layers 503 and 504 are formed of, for example, $Si_3N_4$ or $SiO_2$.

Figure 14B:
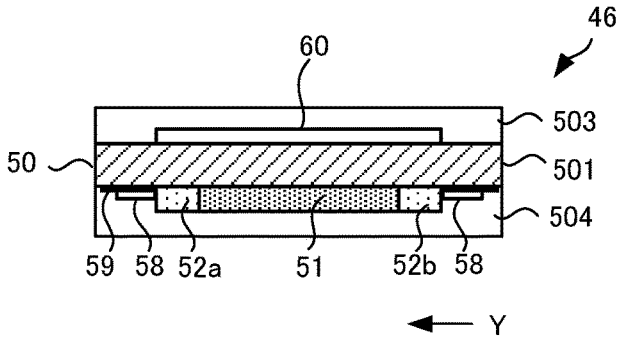

FIG. 14B is a sectional view of the heating member 46 viewed from an arrow A direction in FIG. 14A. As shown in FIG. 14B, the heat generating member 51 is formed on the rear surface of the ceramic substrate 501. The aluminum layers (the electrodes 52*a* and 52*b*) are formed in the Y direction of the heat generating member 51.

The electric conductors 58 for wiring are connected to the electrodes 52*a* and 52*b* at both ends of the heat generating members 51. The electric conductors 58 are connected to the wiring patterns 59 formed on the ceramic substrate 501 by screen printing or the like. The wiring patterns 59 are respectively joined to the switching elements of the driving ICs 53.

In FIGS. 14A to 14D, since the disposition of the heat generating members 51 and the good heat conductors 60 is mainly explained, details of the wiring patterns 59 are omitted. However, if the width in the Y direction of the ceramic substrate 501 is increased, a space for forming the wiring patterns 59 can be secured. In this way, power feed to the heat generating members 51 is performed from the driving source 54 via the wiring patterns 59, the electric conductors 58, and the switching elements of the driving ICs 53.

Figure 14C:
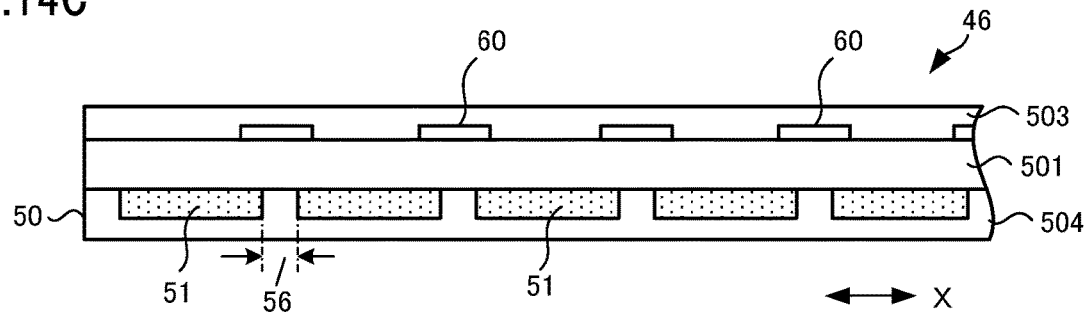

FIG. 14C is a schematic sectional view of the heating member 46 viewed from the Y direction. As seen from FIG. 14C, the heat generating members 51 are disposed on the rear surface of the ceramic substrate 501 and the good heat conductors 60 are disposed on the front surface.

The heat generating members 51 formed on the rear surface of the ceramic substrate 501 are arrayed in the X direction of the ceramic substrate 501 with the gaps 56 having the predetermined width apart from one another. The good heat conductors 60 arrayed on the front surface of the ceramic substrate 501 are arrayed with predetermined gaps apart from one another to compensate for the gaps 56 of the heat generating members 51. The end portions in the X direction of the heat generating members 51 on the rear surface and the good heat conductors 60 on the front surface overlap each other.

Therefore, if the heating member 46 is viewed from right above the figure, the heat generating members 51 are disposed such that the gaps 56 are hidden by the good heat conductors 60. The good heat conductors 60 receive the heat from the heat generating members 51 and passively generate heat to reduce a temperature drop in the gap 56 portions. Consequently, possible to control the heating member 46 to uniform temperature.

Figure 14D:
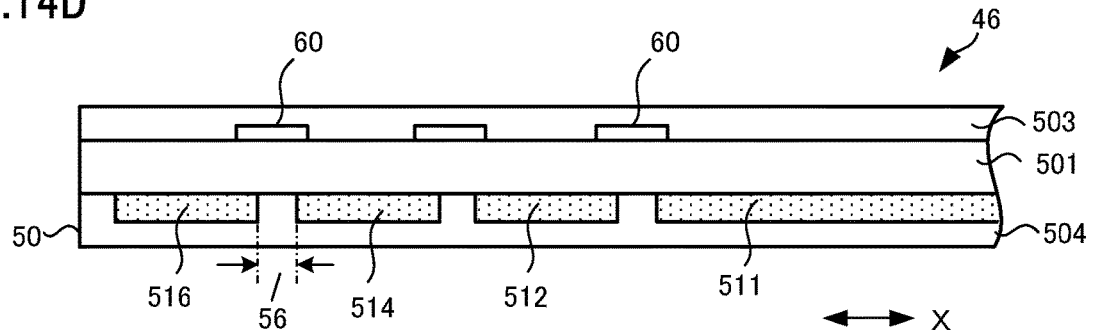

FIG. 14D is a schematic sectional view showing another example of the heating member 46. The heating member 46 shown in FIG. 14D corresponds to the example shown in FIG. 8. In FIG. 14D, only the heat generating members 511, 512, 514, and 516 are shown. The heat generating members 511, 513, 515, and 517 are symmetrical to the disposition of the heat generating members 511, 512, 514, and 516. Illustration of the heat generating members 511, 513, 515, and 517 is omitted.

In the example shown in FIG. 14D, the heat generating members 511, 512, 514, and 516 formed on the rear surface of the ceramic substrate 501 are arrayed in the X direction of the ceramic substrate 501 with the gaps 56 having the predetermined width apart from one another. The good heat conductors 60 on the surface of the ceramic substrate 501 are arrayed to compensate for the gaps 56.

The end portions in the X direction of the heat generating members 511, 512, 514, and 516 and the good heat conductors 60 overlap each other. Therefore, the heat generating members 51 are disposed in the X direction such that the gaps 56 are hidden by the good heat conductors 60. The good heat conductors 60 receive the heat from the heat generating members 51 and passively generate heat to reduce a temperature drop in the gap 56 portions.

With the fixing apparatus according to the embodiment shown in FIGS. 14A to 14D, in the plurality of heat generating members in the heating member 46, insulation among the heat generating members is secured. The good heat conductors 60 present in the gap 56 portions receive the heat from the heat generating members 51 and passively generate heat. Therefore, possible to reduce a temperature drop in the gap portions and reduce occurrence of temperature unevenness.

Note that the heating member 46 shown in FIG. 14D corresponds to the example shown in FIG. 8. However, the heat generating members 511, 512, 513, and 514 may be disposed with the gaps 56 apart from one another on the first surface (e.g., the rear surface) of the ceramic substrate 501 and the good heat conductors 60 may be alternately disposed on the second surface (e.g., the front surface) to correspond to the example shown in FIG. 9.

Figure 15A:
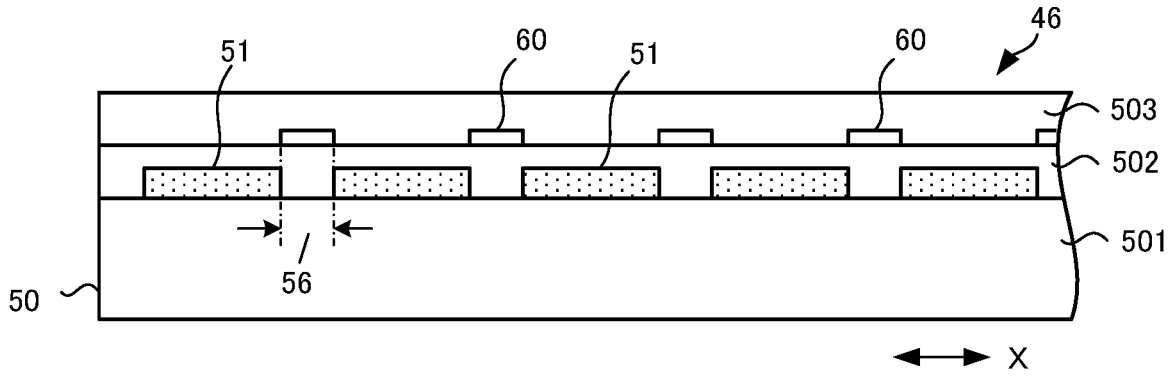
FIGS. 15A and 15B are schematic sectional views showing still another configuration of the heating member in the second embodiment.
Figure 15B:
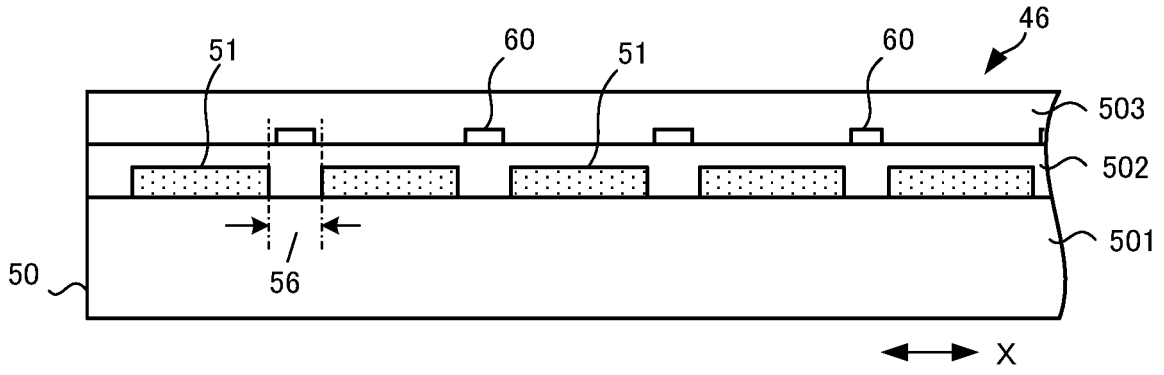

FIGS. 15A and 15B are schematic sectional views showing another modification of the heating member 46. FIGS. 15A and 15B area modification of the array of the heat generating members 51 of the first layer and the good heat conductors 60 of the second layer shown in FIG. 13C. As seen from FIG. 15A, the heat generating members 51 and the good heat conductors 60 are respectively disposed on the ceramic substrates 501 and 502. The heat generating members 51 on the ceramic substrate 501 of the first layer are arrayed in the X direction of the ceramic substrate 501 with the gaps 56 having the predetermined width apart from one another.

The heat generating members 51 of the first layer and the good heat conductors 60 are alternately disposed in the vertical direction. The width in the X direction of the good heat conductors 60 coincides with the gaps 56 opposed thereto.

Therefore, if the heating member 46 is viewed from right above the figure, the heat generating members 51 and the good heat conductors 60 are disposed in the X direction without a gap. That is, as shown in FIG. 10C, the heat generating members 51 of the first layer and the good heat conductors 60 of the second layer do not overlap. However, since the gaps 56 of the first layer are compensated by the good heat conductors 60 of the second layer, it is possible to suppress a temperature drop in the gap 56 portions.

FIG. 15B is another modification of the heating member 46. The heat generating members 51 are arrayed in the X direction with the gaps 56 having the predetermined width apart from one another on the ceramic substrate 501 of the first layer. The good heat conductors 60 of the second layer are arrayed to compensate for the gaps 56.

The heat generating members 51 of the first layer and the good heat conductors 60 of the second layer are alternately disposed in the vertical direction. The end portions in the X direction do not overlap. The width in the X direction of the good heat conductors 60 is slightly smaller than the gaps 56.

Therefore, if the heating member 46 is viewed from right above the figure, the heat generating members 51 and the good heat conductors 60 are disposed in the X direction with a few gaps. As shown in FIG. 14C, the end portions of the heat generating members 51 of the first layer and the good heat conductors 60 of the second layer do not overlap. However, since most of the gaps 56 of the first layer are compensated by the good heat conductors 60 of the second layer, there is an effect of suppressing a temperature drop of the gap 56 portions.

Note that the configuration in which the heat generating members 51 of the first layer and the heat generating members 51 of the second layer do not overlap can be applied to the heating member 46 shown in FIGS. 8 and 9. The configuration can also be applied to the heating member 46 formed on the ceramic substrate 501 having the single layer structure shown in FIGS. 14A to 14D.

Figure 16:
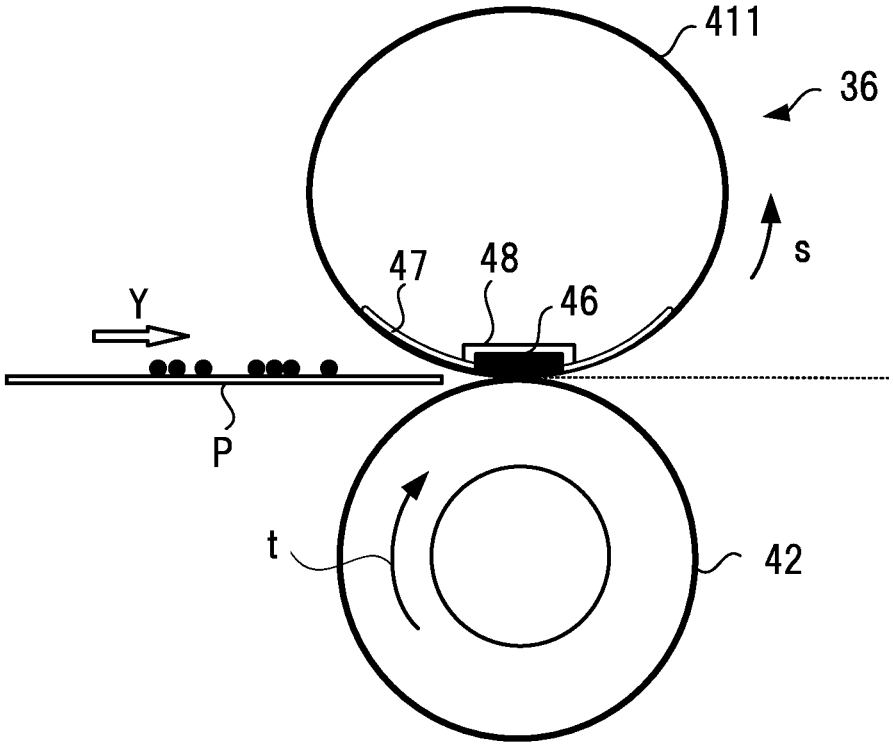
FIG. 16 is a configuration diagram showing a modification of a fixing apparatus according to an embodiment.

FIG. 16 is a configuration diagram showing a modification of the fixing apparatus 36 according to an embodiment. In the fixing apparatus 36 shown in FIG. 16, the fixing belt 41 shown in FIG. 3 is replaced with a cylindrical endless belt 411. The fixing apparatus 36 includes the fixing belt 411, which is a cylindrical rotating body, and the press roller 42.

A driving force is transmitted to the press roller 42 by a motor and the press roller 42 rotates. A rotating direction of the press roller 42 is indicated by an arrow t in FIG. 16. The fixing belt 411 rotates following the rotation of the press roller 42. A rotating direction of the fixing belt 411 is indicated by an arrow s in FIG. 16. The tabular heating member 46 is provided to be opposed to the press roller 42 on the inner side of the fixing belt 411.

An arcuate guide 47 is provided on the inner side of the fixing belt 411. The fixing belt 411 is attached along the outer circumference of the guide 47. The heating member 46 is supported by a supporting member 48 attached to the guide 47. The heating member 46 is in contact with the inner side of the fixing belt 411 and pressed in the direction of the press roller 42. Therefore, a fixing nip having a predetermined width is formed between the fixing belt 411 and the press roller 42. If the sheet P passes the fixing nip, a toner image on the sheet P is fixed on the sheet P with heat and pressure.

That is, the fixing belt 411 revolves around the heating member 46 while being supported by the guide 47. The heating member 46 has the basic configuration shown in FIG. 6 or FIGS. 8 and 9. The heating member 46 is formed on the ceramic substrate 50 of the multilayer structure as shown in FIGS. 10A to 10D (or FIGS. 13A to 13D). Alternatively, the heating member 46 is formed on the ceramic substrate 501 having the single layer structure as shown in FIGS. 11A to 11D (or FIGS. 14A to 14D).

Figure 17:
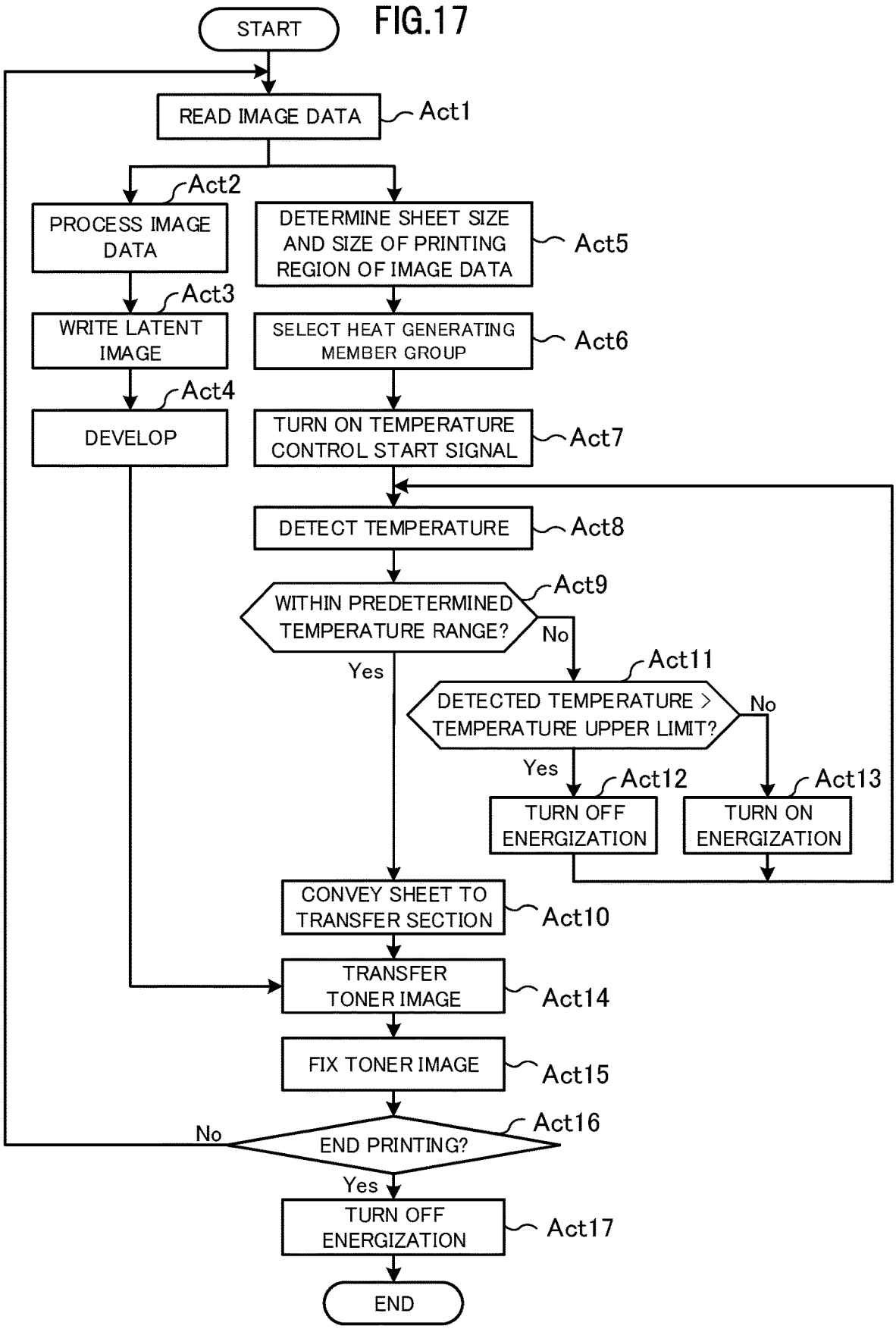
FIG. 17 is a flowchart showing a control operation of an MFP in the embodiment.

Operation during printing of the MFP 10 configured as explained above is explained with reference to a flowchart of FIG. 17. FIG. 17 is a flowchart showing a specific example of control by the MFP 10 in the first embodiment.

First, in Act 1, the scanner unit 15 reads image data. The CPU 100 executes an image formation control program in the imaging forming unit 20 and a fixing temperature control program in the fixing apparatus 36 in parallel.

If image formation processing is started, in Act 2, the CPU 100 processes the read image data. In Act 3, an electrostatic latent image is written on the surface of the photoconductive drum 22. In Act 4, the developing device 24 develops the electrostatic latent image.

On the other hand, if fixing temperature control processing is started, in Act 5, the CPU 100 determines a sheet size and the size of a printing range of the image data. The determination in Act 5 is performed on the basis of, for example, a detection signal of the line sensor 40, sheet selection information by the operation panel 14*a*, or an analysis result of the image data.

In Act 6, the fixing control circuit 150 selects, as a heat generation target, a heat generating member group disposed in a position corresponding to the printing range of the sheet P. For example, in the example shown in FIG. 7, fourteen heat generating members 51 disposed in the center to correspond to the width of the printing region are selected.

Subsequently, in Act 7, the CPU 100 turns on a temperature control start signal to the selected heat generating member group. According to a start of temperature control, energization to the selected heat generating member group is performed and temperature rises.

Subsequently, in Act 8, the CPU 100 detects the surface temperature of the heat generating member group with the temperature detecting member 152 disposed on the inner side or the outer side of the fixing belt 41. Further, in Act 9, the CPU 100 determines whether the surface temperature of the heat generating member group is within a predetermined temperature range. If determining that the surface temperature of the heat generating member group is within the predetermined temperature range (Yes in Act 9), the CPU 100 proceeds to Act 10. On the other hand, if determining that the surface temperature of the heat generating member group is not within the predetermined temperature range (No in Act 9), the CPU 100 proceeds to Act 11.

In Act 11, the CPU 100 determines whether the surface temperature of the heat generating member group exceeds a predetermined temperature upper limit value. If determining that the surface temperature of the heat generating member group exceeds the predetermined temperature upper limit value (Yes in Act 11), in Act 12, the CPU 100 turns off energization to the heat generating member group selected in Act 6 and returns to Act 8.

If determining that the surface temperature of the heat generating member group does not exceed the predetermined temperature upper limit value (No in Act 11), the surface temperature is lower than a predetermined temperature lower limit value according to the determination result in Act 9. Therefore, in Act 13, the CPU 100 maintains the energization to the heat generating member group in the ON state or turns on the energization again and returns to Act 8.

Subsequently, in Act 10, the CPU 100 conveys the sheet P to a transfer section a state in which the surface temperature of the heat generating member group is within the predetermined temperature range. In Act 14, the CPU 100 transfers a toner image onto the sheet P. After transferring the toner image onto the sheet P, the CPU 100 conveys the sheet P into the fixing apparatus 36.

Subsequently, in Act 15, the fixing apparatus 36 fixes the toner image on the sheet P. In Act 16, the CPU 100 determines whether to end the print processing of the image data. If determining to end the print processing (Yes in Act 16), in Act 17, the CPU 100 turns off the energization to all the heat generating member groups and ends the processing. On the other hand, if determining not to end the print processing of the image data yet (No in Act 16), the CPU 100 returns to Act 1. That is, if printing target image data remains, the CPU 100 returns to Act 1 and repeats the same processing until the processing ends.

As explained above, in the fixing apparatus 36 according to the embodiment, the heat generating member group of the heating member 46 (the heater) is disposed in the direction (the X direction) orthogonal to the sheet conveying direction Y. The heating member 46 is disposed in contact with the inner side of the fixing belt 41. Any one of the heat generating member groups is selectively energized to correspond to a printing range (an image forming region) of image data. Therefore, possible to prevent abnormal heat generation of a non-paper passing portion of the sheet of the heating member 46 and suppress useless heating of the non-paper passing portion. Therefore, possible to greatly reduce thermal energy.

Even if the heat generating members of the heating member 46 are disposed with predetermined gaps apart from one another, it is possible to suppress a temperature drop in the gap portions and equalize temperature with heat generation members complementarily disposed in multiple layers and a good heat conductor layer. Therefore, possible to improve fixing quality.

Note that the formation of the heat generation resistance layer and the good heat conductor layer on the ceramic substrate 50 and the formation of the wiring patterns can also be configured by an LTCC (Low Temperature Co-fired ceramics) multilayer substrate. The LTCC multilayer substrate is known as a low-temperature baked stacked ceramics substrate formed by simultaneously baking a wiring conductor and a ceramics substrate at low temperature of, for example, 900° C. or less. Also possible to realize the LTCC multilayer structure by forming a layer of a heat-resistant insulating body through various film formation (thin film and thick film) processes.

While certain embodiments have been described, these embodiments have been presented by way of example only, and are not intended to limit the scope of the invention. Indeed, the novel apparatus described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

What is claimed is:

1. A heater comprising:

a heat-resistant insulating substrate;

a plurality of heat generating members arrayed in a first direction on a first surface of the substrate; and a plurality of heat conductors disposed on a surface different from the first surface of the substrate at positions corresponding to gap portions between the heat generating members to passively radiate heat generated thereby.

2. The heater according to claim 1, wherein the heat conductors are disposed to overlap end portions in the first direction of the heat generating members.

3. The heater according to claim 1, wherein each of the heat generating members has electrodes at end portions thereof in a second direction orthogonal to the first direction, and the heat conductors are disposed to partially overlap the electrodes in a third direction orthogonal to the first and second directions.

4. The heater according to claim 3, wherein said each of the heat generating members is electrically connected to a power source via the electrodes.

5. The heater according to claim 3, wherein the electrodes include a first electrode formed at one of the end portions and a second electrode formed at the other of the end portions, and two of the heat conductors that are adjacent to each other partially overlap the first and second electrodes of one of the heat generating members in the third direction.

6. The heater according to claim 3, further comprising:

a conductor extending from each of the electrodes along the second direction, wherein an end of the conductor not connected to said each of the electrodes does not overlap any of the heat conductors in the third direction.

7. The heater according to claim 1, wherein the substrate is formed in a multilayer structure, the heat generating members are arranged in a first layer of the substrate, and the heat conductors are disposed in a second layer of the substrate adjacent to the first layer.

8. The heater according to claim 1, wherein the substrate is formed in a multilayer structure, the heat generating members are arranged on a first surface of one of layers of the substrate, and the heat conductors are disposed in a second surface of said one of layers of the substrate, the second surface facing the first surface.

9. The heater according to claim 1, wherein in the first direction, each of the heat conductors has a width that is identical with a width of the gap portions.

10. The heater according to claim 1, wherein the heat conductors are disposed to not overlap any of the heat generating members in a direction orthogonal to the substrate.

11. A heating apparatus comprising:

a rotating body extending along a first direction orthogonal to a conveying direction of a medium to be heated; and a heater including:

a heat-resistant insulating substrate, a plurality of heat generating members arrayed in the first direction on a first surface of the substrate, and a plurality of heat conductors disposed on a surface different from the first surface of the substrate at positions corresponding to gap portions between the heat generating members to passively radiate heat generated thereby.

12. The heating apparatus according to claim 11, wherein the heat conductors are disposed to overlap end portions in the first direction of the heat generating members.

13. The heating apparatus according to claim 11, wherein each of the heat generating members has electrodes at end portions thereof in a second direction orthogonal to the first direction, and the heat conductors are disposed to partially overlap the electrodes in a third direction orthogonal to the first and second directions.

14. The heating apparatus according to claim 13, wherein said each of the heat generating members is electrically connected to a power source via the electrodes.

15. The heating apparatus according to claim 13, wherein the electrodes include a first electrode formed at one of the end portions and a second electrode formed at the other of the end portions, and two of the heat conductors that are adjacent to each other partially overlap the first and second electrodes of one of the heat generating members in the third direction.

16. The heating apparatus according to claim 13, wherein the heater further includes a conductor extending from each of the electrodes along the second direction, and an end of the conductor not connected to said each of the electrodes in the second direction does not overlap any of the heat conductors in the third direction.

17. The heating apparatus according to claim 11, wherein the substrate is formed in a multilayer structure, the heat generating members are arranged in a first layer of the substrate, and the heat conductors are disposed in a second layer of the substrate adjacent to the first layer.

18. The heating apparatus according to claim 11, wherein the substrate is formed in a multilayer structure, the heat generating members are arranged on a first surface of one of layers of the substrate, and the heat conductors are disposed in a second surface of said one of layers of the substrate, the second surface facing the first surface.

19. The heating apparatus according to claim 11, wherein in the first direction, each of the heat conductors has a width that is identical with a width of the gap portions.

20. The heating apparatus according to claim 11, wherein the heat conductors are disposed to not overlap any of the heat generating members in a direction orthogonal to the substrate.

* * * * *